US007125388B1

(12) United States Patent
Reinkensmeyer et al.

(10) Patent No.: US 7,125,388 B1
(45) Date of Patent: Oct. 24, 2006

(54) ROBOTIC GAIT REHABILITATION BY OPTIMAL MOTION OF THE HIP

(75) Inventors: David J. Reinkensmeyer, Irvine, CA (US); Susan J. Harkema, Culver City, CA (US); V. Reggie Edgerton, Los Angeles, CA (US); James Bobrow, Huntington Beach, CA (US); Chia Yu Wang, Tainan (TW)

(73) Assignee: The Regents of the University of California, Oakland, CA (US)

( * ) Notice: Subject to any disclaimer, the term of this patent is extended or adjusted under 35 U.S.C. 154(b) by 0 days.

(21) Appl. No.: 10/441,730

(22) Filed: May 20, 2003

Related U.S. Application Data

(60) Provisional application No. 60/382,137, filed on May 20, 2002.

(51) Int. Cl.
*A61H 3/00* (2006.01)

(52) U.S. Cl. ..... 601/5; 601/23; 601/35

(58) Field of Classification Search ..... 601/5, 601/23, 33, 34, 35; 482/54, 69, 78, 143; 623/24
See application file for complete search history.

(56) References Cited

U.S. PATENT DOCUMENTS 2,109,188 A * 2/1938 Bajanova ..... 482/69
3,780,663 A * 12/1973 Pettit ..... 104/307
5,020,790 A * 6/1991 Beard et al. ..... 482/4
5,320,590 A * 6/1994 Poplawski ..... 602/5
5,502,851 A * 4/1996 Costello ..... 5/86.1
5,830,162 A * 11/1998 Giovannetti ..... 601/23
5,941,800 A * 8/1999 Laconis ..... 482/70
5,997,444 A * 12/1999 McBride ..... 482/69
6,217,532 B1 * 4/2001 Blanchard et al. ..... 601/23
6,296,595 B1 10/2001 Stark et al.
6,770,040 B1 * 8/2004 Perner et al. ..... 601/5
6,821,233 B1 * 11/2004 Colombo et al. ..... 482/54
2002/0026130 A1 * 2/2002 West ..... 601/23

OTHER PUBLICATIONS

International Search Report, dated Nov. 22, 2004.

* cited by examiner

*Primary Examiner*—Danton DeMille
(74) *Attorney, Agent, or Firm*—Berliner & Associates

(57) ABSTRACT

A method and a robotic device for locomotion training. The method involves shifting a subject's pelvis without directly contacting the subject's leg, thereby causing the subject's legs to move along a moveable surface. The device comprises two backdriveable robots, each having three pneumatic cylinders that connect to each other at their rod ends for attachment to the subject's torso. Also provided is a method of determining a locomotion training strategy for a pelvic-shifting robot by incorporating dynamic motion optimization.

26 Claims, 22 Drawing Sheets

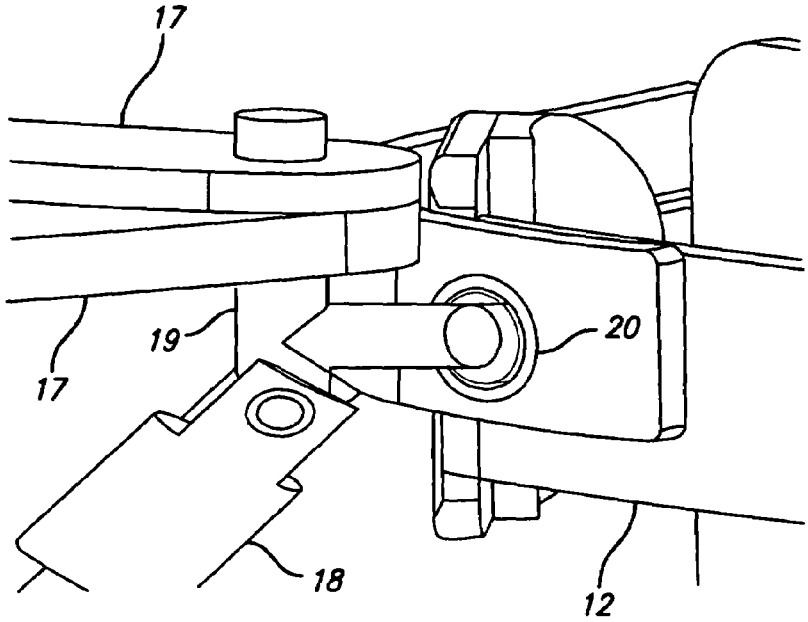
FIG. 3
FIG. 4
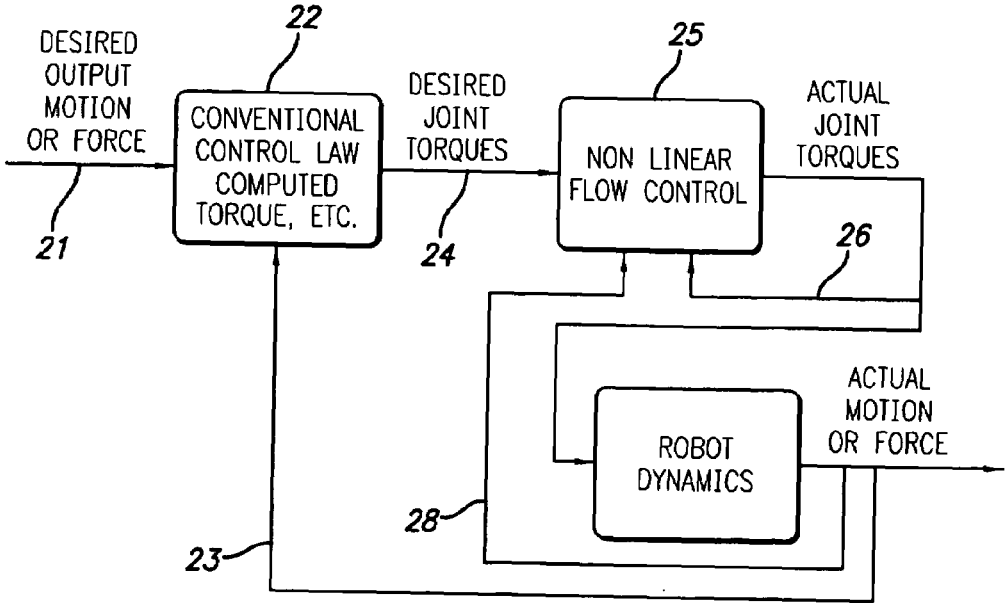

ROBOTIC GAIT REHABILITATION BY OPTIMAL MOTION OF THE HIP

CROSS-REFERENCE TO RELATED APPLICATIONS

This application claims the benefit of provisional application No. 60/382,137 filed on May 20, 2002.

STATEMENT REGARDING FEDERALLY SPONSORED RESEARCH OR DEVELOPMENT

This invention was made with Government Support under Grant No. ATP 00-00-4906, awarded by the National Institute of Standards and Technology. The Government has certain rights in this invention.

BACKGROUND

1. Field of Invention

This invention relates generally to a method and device for controlling the stepping motion of a subject undergoing locomotion rehabilitation.

2. Related Art

In the U.S. alone, over 700,000 people experience a stroke each year, and over 10,000 people experience a traumatic spinal cord injury. Impairment in walking ability after such neurologic injuries is common. Recently, a new approach to locomotion rehabilitation called body weight supported (herein referred to as "BWS") training has shown promise in improving locomotion after stroke and spinal cord injury (6, 19). The technique involves suspending the patient in a harness above a treadmill in order to partially relieve the weight of the body, and manually assisting the legs and hips in moving in a walking pattern. Patients who receive this therapy can significantly increase their independent walking ability and overground walking speed (2). It is hypothesized that the technique works in part by stimulating remaining force, position, and touch sensors in the legs during stepping in a repetitive manner, and that residual circuits in the nervous system learn from this sensor input to generate motor output appropriate for stepping. The continued development of BWS training provides paralyzed patients with the hope of regaining at least some degree of mobility.

Clinical access to BWS training is currently limited because the training is labor intensive. Multiple therapists are often required to control the hips and legs. Several research groups are pursuing robotic implementations of BWS training in an attempt to make the training less labor intensive, more consistent, and more widely accessible (3, 7, 12). Implementing BWS training with robotics is also attractive because it could improve experimental control over the training, thus providing a means to better understand and optimize its effects.

One robotic device for locomotion training is the Lokomat, which consists of four rotary joints, driven by precision ball screws connected to DC motors, which are mounted onto a motorized exoskeleton to manipulate a patient's legs in gait-like trajectories (5). Another device is the Mechanized Gait Trainer (MGT), which comprises two foot plates connected to a double crank and rocker system that is singly actuated by an induction motor via a planetary gear system and drives a patient's legs in a walking pattern (8). The ARTHuR robot makes use of a linear motor and a two degree-of-freedom mechanism to measure and manipulate leg movement during stepping with good backdriveability and force control (13). Other devices under development include HealthSouth's Autoambulator, and a more sophisticated version of the MGT that can move the footplates along arbitrary three degree-of-freedom trajectories.

These initial gait-training devices have focused primarily on controlling leg movement. However, torso motion also plays an important role in normal locomotion. The MGT has taken the simplified approach of moving the torso with a single mechanism along a fixed trajectory that approximates the vertical trajectory achieved during normal stepping. Such a fixed trajectory cannot be optimal for every patient. In addition, this approach requires the same torso motion to be applied regardless of the stage of recovery of the patient. The Lokomat restricts horizontal and pelvic rotation motions, and simply allows the patient to move up and down without controlling the up-and-down motion. In gait training, patient-specific torso motions may be useful for generating desired gait patterns (18). Thus, a device that manipulates the torso would enhance the flexibility of BWS training.

Robotic devices for gait training preferably exhibit good backdriveability, defined as low intrinsic endpoint mechanical impedance (10), or accurate reproduction at the input end of a mechanical transmission of a force or motion that is applied at the output end (15). Good backdriveability offers several important benefits for robotic therapy devices (13), including the ability for the device to act as a passive motion capture device. In such a passive motion capture mode, the patient's movement ability can be quantified, and the therapist can manually specify desired, patient-specific training motions for the device.

One difficulty in automating BWS training is that the required patterns of forces at the hips and legs are unknown. For example, the relative importance of assisting at the hip and leg is unclear. One approach toward determining the required forces is to instrument the therapists' hands with force and position transducers (3). However, therapists are relatively limited in the forces that they can apply compared to robots, and there is no guarantee that any given therapist has selected an optimal solution.

An alternate approach toward generating strategies for assisting in gait training is dynamic motion optimization. Dynamic motion optimization provides a formalized method for determining motions for underconstrained tasks, and may reveal novel strategies for achieving the tasks. It has been used with success to simulate human control over such activities as diving, jumping, and walking (1, 9, 11).

SUMMARY

The present invention provides a method of locomotion training which involves shifting a subject's pelvis without directly touching the subject's legs. The method comprises: (a) providing a surface; (b) supporting the subject over the surface so that at least one of the subject's legs is positioned on the surface; and (c) shifting the supported subject's pelvis, which causes the subject's legs to move along the surface. The surface can be fixed or moveable. The pelvis can be shifted manually or robotically. In specific embodiments, the subject is suspended on a treadmill and the pelvis is shifted by attaching a robot to the subject's torso. A leg swing motion is created by moving the pelvis without contact with the legs.

The present invention also provides a method of determining a locomotion training strategy using dynamic motion optimization. As used herein, a locomotion training strategy is a sequence of body segment trajectories that can be imposed on a subject to obtain a desired gait. The method comprises (a) formulating an optimal control problem for a locomotory model, (b) inputting joint parameters, (c) solving the optimal control problem, and (d) deriving a sequence of body segment trajectories in accordance with the optimization. The model can be of any animal but is preferably a human model. In certain embodiments, an under-actuated human model can be employed and the trajectories can be leg or pelvic trajectories.

The present invention further provides a robotic device for manipulating and/or measuring the pelvic motion of a subject undergoing locomotion training. The device comprises at least one backdriveable robot for attaching to the torso of the subject and for applying force to the subject's pelvis. The robot can be powered by pneumatic, hydraulic or electric actuators. In preferred embodiments, the robot comprises a plurality of pneumatic actuators, which are preferably pneumatic cylinders.

The robotic device can be used to manipulate a subject's pelvis in order to move the subject's legs. Alternatively, the pelvis can be manipulated for its own sake without regard for leg movement. In addition, the device can be used to manipulate the pelvis while the legs are also manipulated, either robotically or manually by a therapist.

The present invention is further directed to a system for locomotion therapy. The system comprises (a) a surface, (b) a support system for supporting a subject over the surface so that at least one of the subject's legs is positioned on the surface, and (c) a robotic device comprising at least one backdriveable robot for attaching to the torso of the supported subject and for applying force to the pelvis of the supported subject.

The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF DRAWINGS

FIG. 3 is a close-up view of the rod ends of three pneumatic cylinders which compose a robot of the present invention;

FIG. 4 is a flow chart illustrating a hierarchical control system for a pneumatically actuated robot;

DETAILED DESCRIPTION

Figure 1:
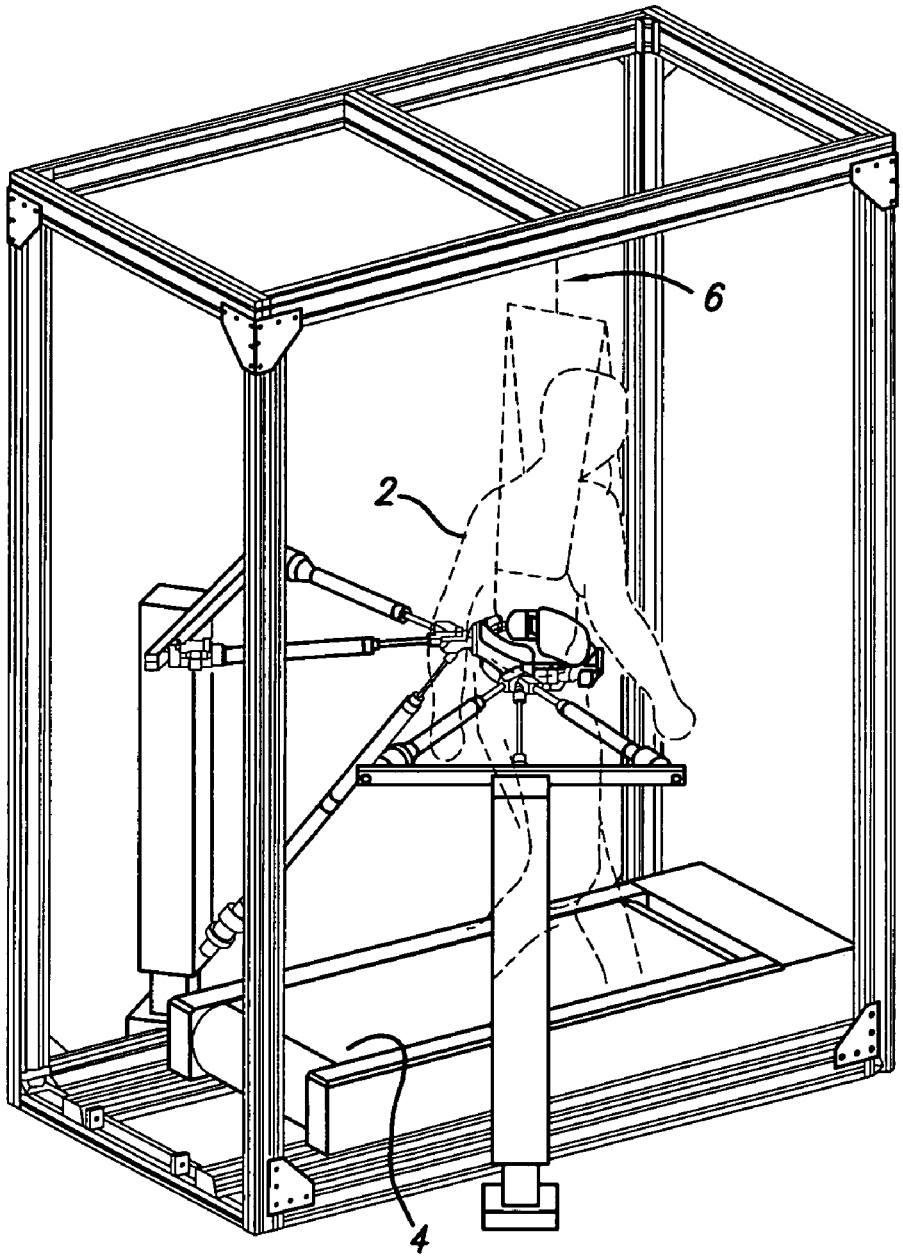
FIG. 1 is a perspective view of a suspended person undergoing locomotion training in accordance with the present invention.

Referring to FIG. 1, in accordance with the present invention, a subject 2 is suspended over a moveable surface 4 and a robotic device is attached to the subject's torso. The moveable surface can be a surface provided by devices well known in the art such as a motorized treadmill, a conveyor belt, or a moving walkway. A suitable suspension system 6 such as a counterweight, spring, or pneumatic system is also well known in the art. Preferably, the suspension system can partially unload the subject's weight to a desired level of support. Alternatively, the subject can be held and supported over the surface by the robotic device itself without the need for a separate support system.

Figure 2:
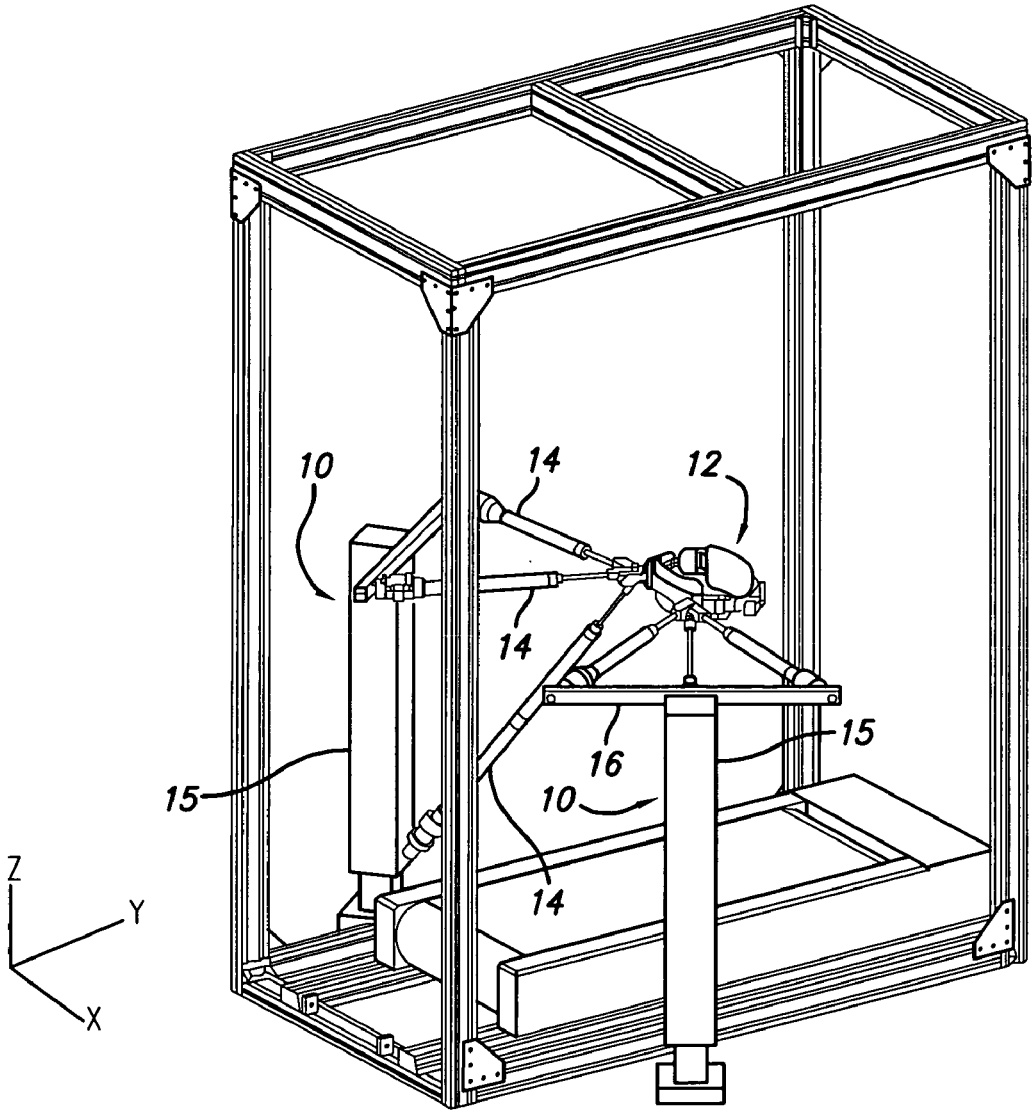
FIG. 2 is a perspective view showing a preferred embodiment of the robotic device.

Referring to FIG. 2, a specific embodiment of the robotic device comprises a pair of backdriveable pneumatic robots 10 that attach to the back of a belt 12 worn by a subject. Each robot comprises three pneumatic cylinders 14 that are rotatably connected to a support pillar 15, in this case via ball-joints. Two cylinders lie coplanar in the horizontal plane and connect to the support pillar through a cross-bar 16; the third cylinder lies in an oblique plane to provide upward forces. Each robot has three degrees of freedom and exhibits good backdriveability.

As shown in FIG. 3, the rod end 17 of each horizontal cylinder and the rod end 18 of the oblique cylinder rotatably connect to a post 19 through their lines of center. The post 19 is connected to a revolute joint 20 on the belt 12.

Each three-cylinder robot can be mounted to an adjustable slide that allows the robots to be moved vertically to accommodate subjects of various hip heights. The mounting of the pneumatic cylinders on ball joints minimizes the moments that can be imparted onto the pistons, preventing damage to the cylinders. The resulting system has five degrees of freedom, relative to the axes in FIG. 2, providing control of three translations, i.e., side-to-side, forward-and-back, up-and-down, and two rotations, i.e., pelvic swivel about the Z-axis, and pelvic tilt about the Y axis. One rotation cannot be controlled—pelvic rotation about the X-axis.

When the cylinders are vented, they have excellent backdriveability. When the cylinders are pressurized, nonlinear control laws have been developed that allow force- and position control with a bandwidth of approximately 5 Hz, which is sufficient to control human pelvic motion.

As shown in FIG. 1, the cylinders attach to the belt behind the subject, allowing the subject to swing the arm naturally during gait, and providing an unobstructed view for the subject. The cylinders can be angled in from the sides with sufficient spacing to allow a subject to enter the device via a wheelchair, and to allow a therapist to access the subject from both behind and on the sides.

The device can be used to measure and record the movements and body segment trajectories of a subject. To record movements, the pneumatic cylinders are vented and the device is used in a passive mode. The cylinders are instrumented with linear potentiometers. The position and orientation of the pelvis can be inferred in real-time from the potentiometer measurements using the forward kinematics of the mechanism.

The device can be used to playback desired movements including movement previously recorded or specified by a therapist. To replay desired movements, a hierarchical control system such as one provided in Bobrow, J. E. and B. W. McDonell, "Modeling, Identification, and Control of a Pneumatically Actuated, Force Controllable Robot", IEEE Transactions on Robotics and Automation, vol. 14, pp. 732–42, 1998, can be used for which the actuator dynamics are separated from the rigid body dynamics of the robot. Referring to FIG. 4 showing such a hierarchical control system, the first step is the inputting of a desired output motion or force 21. Next, a well-established robot control algorithm 22, which uses feedback 23 from the robot position and force sensors, is used to create the desired output motion. One such control algorithm is the "computed torque" method which is known to perform well for robots using electric motors as the actuators. The computed torque method requires that the actuators create a desired torque 24. A nonlinear gas flow control law 25 is then used to ensure that the pneumatic actuators produce the desired torques. The nonlinear control law can use feedback 26 from the actual torques and feedback 28 from the robot position and force sensors.

The hierarchical control system permits well-established control laws, like those used for motor driven robots, to be used for the pneumatic device. To achieve this hierarchy, the nonlinear compressible air flow dynamics for each cylinder and servovalve are modeled and controlled. Also, pressure sensors are used on both sides of the pistons for feedback in order to achieve fast and accurate force control for each cylinder of the system. This transforms the control problem into one that is standard for robotic control designers. The inner-loop force control law is:

$$u = \left[-k_p(P_1A_1 - P_2A_2 - P_0A_0 - F_d) + k_v\left(\frac{P_1\dot{V}_1A_1}{V_1} - \frac{P_2\dot{V}_2A_2}{V_2}\right)\right]k_g(x)$$

where:

$k_v$—governs feed-forward control due to piston motion $P_1$, $P_2$—absolute pressures on each side of the piston $A_1$, $A_2$—areas on each side of the piston $P_0$—atmospheric pressure $A_0$—cross-sectional area of the rod $F_d$—desired force $V_1$, $k_p$—governs response time of the force control subsystem $V_2$—volumes on each side of the piston $k_g(x)$—nonlinear loop gain u—voltage control signal into proportional servo valve This control approach has been applied to a three degree of freedom pneumatic robot by Bobrow, J. E. and B. W. McDonell, "Modeling, Identification, and Control of a Pneumatically Actuated, Force Controllable Robot", IEEE Transactions on Robotics and Automation, vol. 14, pp. 732–42, 1998, where the bandwidth of the force control algorithm has been calculated to be approximately 5 Hz, ample for controlling even brisk human movement. Also, the position-controlled robot, which was slightly larger than a human arm, has been observed to move along a trajectory programmed to pass through five extreme positions across the robot's workspace in a six second period with an average joint trajectory error less than 2 degrees.

To enhance the safety of the robotic device of the present invention, redundant mechanical, electrical, and software safety features are incorporated. The device has mechanical hard stops that limit pelvic rotation to twelve degrees. Pressure-actuated safety valves vent both sides of each cylinder to leave the system in its passive state in case the main supply pressure is cut. Main supply pressure is vented with an electrically controlled valve when an emergency stop button is pressed. Main supply pressure is also vented when software limits on position, velocity, and pressure are exceeded.

As will be apparent to one of skill in the art, a robotic device of the present invention can be used to manipulate and measure the limb movement of a subject undergoing physical training of a limb. When used in this manner, the limb is preferably the leg of a subject undergoing locomotion therapy.

The present invention further provides a method of determining a locomotion training strategy for a subject supported over a moveable surface such as a treadmill. The problem of determining an appropriate sequence of body segment trajectories for a paralyzed subject can be formulated as an optimal control problem for an under-actuated articulated chain. In this formulation, the optimal control problem can be converted into a discrete parameter optimization, and an efficient gradient-based algorithm can be used to solve it. Motion capture data from a human subject can be compared to the results from the dynamic motion optimization. The present invention makes it possible for a robot to create a gait for the paralyzed subject that is close to that of an unimpaired subject.

Figure 5:
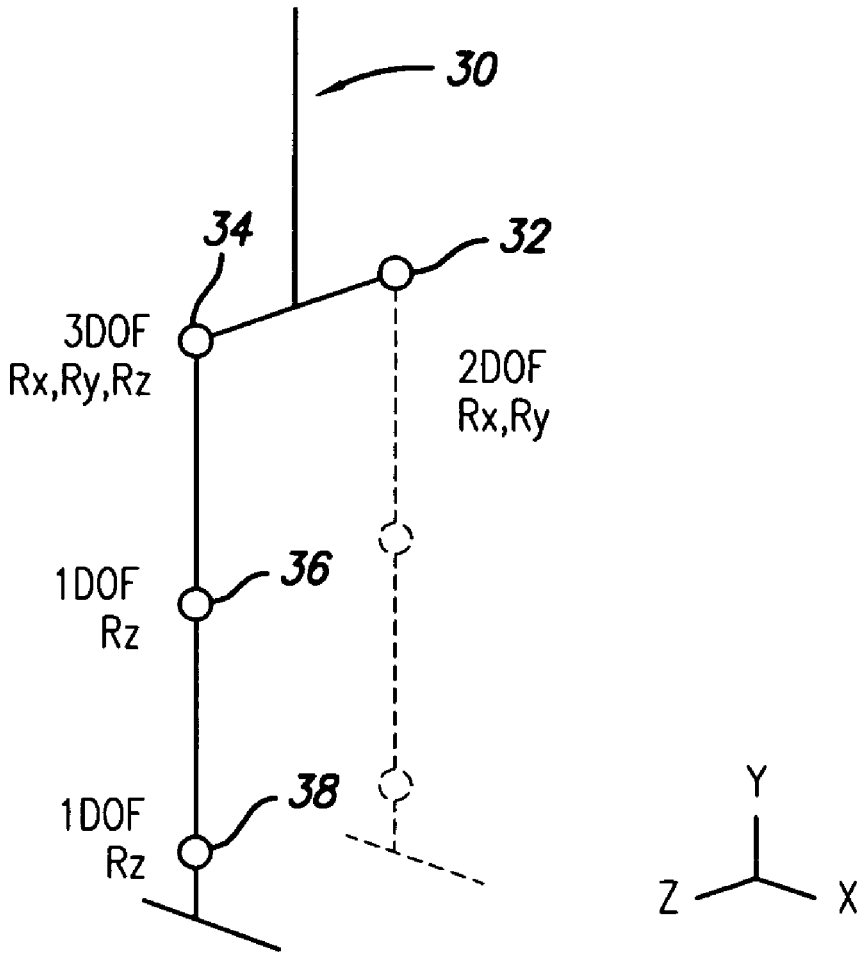
FIG. 5 is a schematic representation of the joints used to model a human for dynamic motion optimization.

Referring to FIG. 5, to provide a human model, the head, torso, pelvis, and arms can be combined into a single rigid body referred to as the upper trunk 30. The walking gait cycle can be assumed to be bilaterally symmetric. That is, in the gait cycle, the right-side stance and swing phases are assumed to be identical to the left-side stance and swing phases, respectively. Based on this assumption, only one-half of the gait cycle can be simulated. The joints on the side of the stance phase are referred to as the stance joints and the joints on the side of the swing phase as the swing joints. The stance hip 32 can be modeled as a two degree-of-freedom universal joint rotating about axes oriented in the x- and y-directions. These are the degrees of freedom assumed to be controlled by a robotic device. The upper trunk can be assumed to remain at a fixed angle about the z axis. The swing hip 34 can be modeled as a three degree-of-freedom ball joint rotating about axes in the in the x- (i.e. leg adduction/abduction), y- (hip internal/external rotation), and z- (i.e. hip flexion/extension) directions. The knee 36 and ankle 38 can be modeled as one degree-of-freedom hinge joints about the z-axis (knee extension/flexion and ankle dorsal/plantar flexion, respectively).

Motion capture data of key body segments for an unimpaired subject during treadmill walking can be obtained using a video-based system (Motion Analysis Corp., Santa Rosa, Calif.). External markers can be attached to the subject at the antero-superior iliac spines (ASISs), knees, ankles, tops of the toes, and backs of the heels. Representative steps can be chosen for comparison with the optimization results. A least squares method can be used to convert the positions of the markers to the link lengths and joint angles based on the forward kinematics of the human model. Dynamic properties of the body segments can be estimated using regression equations based on segment kinematic measurements such as shown by Zatsiorsky, V., and Seluyanov, V., "Estimation of the Mass and Inertia Characteristics of the Human Body by Means of the Best Predictive Regression Equations", Biomechanics IX-B 233–239, 1985.

Passive torque-angle properties of the hip, knee, and ankle joints can be measured for the subject with a motorized dynamometer (Biodex Inc., Shirley, N.Y.). The dynamometer can impose slow isovelocity movements at the joints and can measure applied torques and resulting joint angles. Joints can be measured in a gravity-eliminated configuration, or, if not possible, torques due to gravity can be estimated and subtracted. The joints can be modeled as nonlinear springs in which the joint torque is a polynomial function of the joint angle. A least squares method can be used to obtain the best-fit polynomial of order 3 for the torque-angle properties of each of the joints.

To formulate the optimal control problem, a robot is assumed to be capable of moving the pelvis such that the stance hip moves along a normal, unimpaired trajectory, while simultaneously lifting the swing hip to control movement of the swing leg. In addition, the robot-assisted motion is assumed to be initiated when the treadmill has pulled the stance leg backward to the position from which swing would normally be initiated, with the foot's horizontal and vertical velocity equal to zero. The robot-generated motion can then initiate the transition from stance to swing, driving the leg toward the desired foot-fall location. The swing leg can be modeled as a paralyzed (i.e. unactuated) linkage with specified passive torque-angle properties.

This problem can be addressed mathematically as an optimal control problem for an under-actuated system. The goal is to obtain a normal swing phase of the paralyzed leg, starting with the leg in an extended position with zero initial joint velocities by shifting the pelvis. The motion of the stance hip found from video capture data of an unimpaired subject can be used as an input to an under-actuated human model. Specifically, the stance hip joint center locations can be approximated using B-spline curves based on the motion capture data. The swing motion can be considered to be an optimal control problem as follows:

$$\underset{\tau(t)}{\text{Minimize}}\ J_c = \frac{1}{2}\int_0^{tf}\sum_{i=4}^{10} w_{ei}\tau_i^2\,dt + J_p(q,\dot{q}) \tag{1}$$

$$\text{Subject to } H(q)\ddot{q}+h(q,\dot{q})=\tau+\tau_{st} \tag{2}$$

$$\underline{q}\leq q\leq\overline{q} \tag{3}$$

$$q(0)=qo,\dot{q}(0)=\dot{q}o \tag{4}$$

$$q(t_f)=q_f,\dot{q}(t_f)=\dot{q}_f \tag{5}$$

Equation (2) represents the dynamics for the human model with the 10 joint coordinates q, the joint forces or torques $\tau$, and the measured passive torques due to soft tissue stiffness $\tau_{st}$. H(q) is the generalized mass matrix and h(q, $\dot{q}$) contains the centrifugal, Coriolis and gravitational forces. $\tau_1$, $\tau_2$, and $\tau_3$ are the generalized forces associated with the translation of the stance hip (and are not included in the cost function since the position of the stance hip was specified by the motion capture data); $\tau_4$ and $\tau_5$ are the moments corresponding to the two rotations of the stance hip (controlled by the robot); $\tau_6$, $\tau_7$, and $\tau_8$ are the swing hip moments (corresponding to hip abduction/adduction, external/internal rotation, and extension/flexion, respectively); $\tau_9$ and $\tau_{10}$ correspond to knee and ankle rotation moments, respectively; and $w_{ei}$'s are positive weighting coefficients. $\tau_6$ to $\tau_{10}$ were assumed zero for the impaired leg. $\tau_{st4}$ to $\tau_{st10}$ were modeled as nonlinear spring-damper systems to capture the passive torque-angle properties of the joints, as described above, while $\tau_{st1}$, to $\tau_{st3}$ were zero since no muscular force was needed for the linear translation of the stance hip (i.e. the robot was assumed to control these degrees of freedom). The term $J_p(q, \dot{q})$ in Equation (1) is a penalty function used to avoid collision of the swing leg with the stance leg and the ground and to achieve the final desired position. This was achieved by introducing two functions which penalized the penetration of the swing leg with the stance leg and the ground.

To formulate the optimal control problem for a numerical solution, the joint trajectories can be interpolated by uniform, $C^4$ continuous quintic B-spline polynomials over the knot space of an ordered time sequence. For the simulation of the paralyzed patient, the system can be modeled as an under-actuated system with two actuated joints ($q_4$ and $q_5$) and five passive, or unactuated, joints ($q_6$, $q_7$, $q_8$, $q_9$, and $q_{10}$). The dynamics of such a hybrid dynamic system can be solved efficiently by a Lie group formulation such as one provided by Sohl, G. A., and Bobrow, J. E., A recursive multibody dynamics and sensitivity algorithm for branched kinematic chains. ASME Journal of Dynamic Systems, Measurement and Control, 391–399, 2001. In order to perform the optimization, an initial trajectory is required for the actuated joints. The trajectory identified from motion capture can be used as an initial trajectory. The identified trajectory can be defined with the parameter set P such that $q_a=q_a(t, P)$. Given the motion of the actuated joints, the dynamics of the partially actuated system can be integrated numerically from the given initial conditions using a numerical solution function such as Matlab's function "ode45", and a dynamics software such as the Cstorm dynamics software provided by Sohl, G. A., and Bobrow, J. E., A recursive multibody dynamics and sensitivity algorithm for branched kinematic chains. ASME Journal of Dynamic Systems, Measurement and Control, 391–399, 2001. The foregoing steps serve to transform the optimal control problem in Equation (1) into a discrete parameter optimization over the parameter set P.

Motions can be generated by this dynamic motion optimization using different weighting coefficients for different cases. Weighting coefficients can be chosen based on experience with many simulations by guaging how accurately the coefficients produce the desired motions of the pelvis and leg. In each case, 8 variable parameters can be used for each of the actuated joints. Joint torques can be computed for the human model based on the estimated dynamic properties and the B-spline joint trajectories.

Dynamic motion optimization provides a useful tool for investigating novel strategies for assisting in locomotion rehabilitation (16). Finding strategies by observation of therapists is also desirable, but may miss some valuable strategies because therapists are limited in control relative to robots. Dynamic motion optimization also provides a formal means to automatically generate strategies on a patient-by-patient basis by including patient-specific passive joint and reflex properties in the simulation. In addition, as a patient begins to recover control over some muscles, this activation can be modeled and included in the simulation. As the patient recovers walking ability, the simulations can progress from unactuated, to partially actuated, to fully actuated simulations, with the optimization algorithm automatically determining the appropriate assistance strategy for each recovery state.

EXAMPLES

Example 1

This example shows the robotic device in motion capture mode.

Each robot of the device uses three 1.5" diameter pneumatic cylinders, each cylinder with a 12" stroke. The device can generate about 350 lbs of force in the X-direction, 200 lbs of force in the Y-direction, and 140 lbs of force in the Z-direction, with reference to the X,Y and Z axes of FIG. 2, at a 100 PSI supply pressure. The positions of the cylinder rods are measured by an analog voltage signal from potentiometers that are integral within the cylinders. Pressures on each side of each cylinder are measured using low-cost pressure sensors. The system is controlled using Matlab xPC target.

Figure 6A:
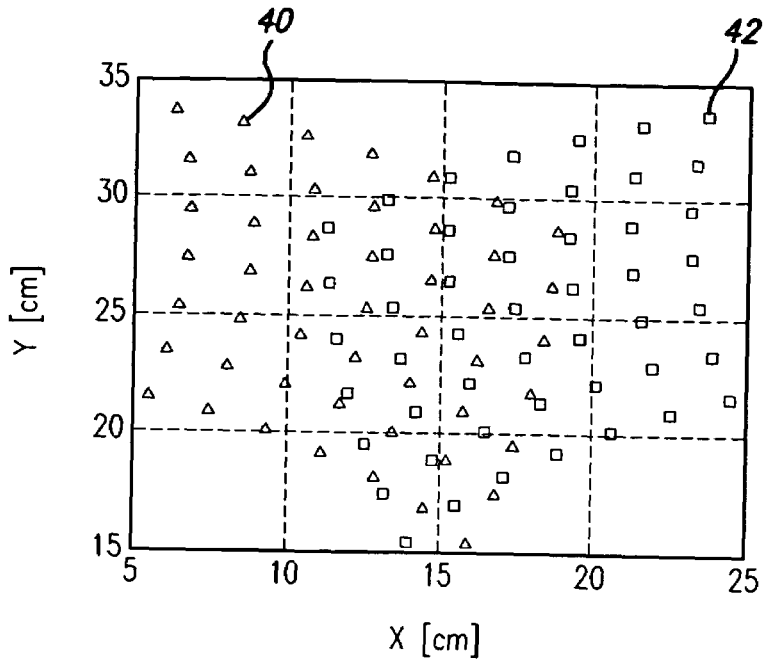
FIGS. 6A and 6B are graphs showing the workspace of a robotic device of the present invention.
Figure 6B:
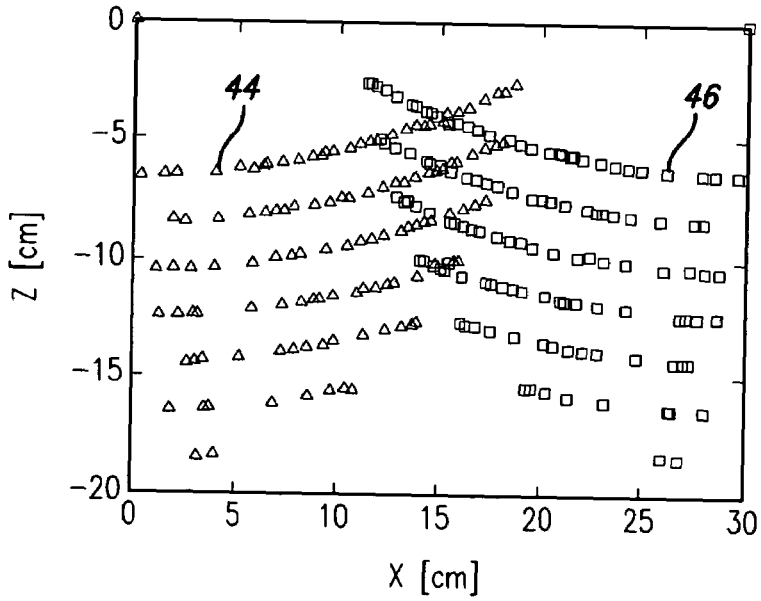

The cylinder lengths can accommodate hip movement within an approximately 15-centimeter sphere. The resulting workspace allows for both normative and moderately exaggerated hip movements should they be necessary. FIG. 6A shows the workspace of the device in the horizontal (X-Y) plane, where the X, Y and Z axes are oriented as in FIG. 2. In FIG. 6A, a triangle 40 represents a position of the left attachment point to subject, and a square 42 represents a position of the right attachment point to subject. FIG. 6B shows the workspace of the device in the X-Z plane, where a triangle 44 represents a left attachment point position and a square 46 represents a right attachment point position.

Figure 7B:
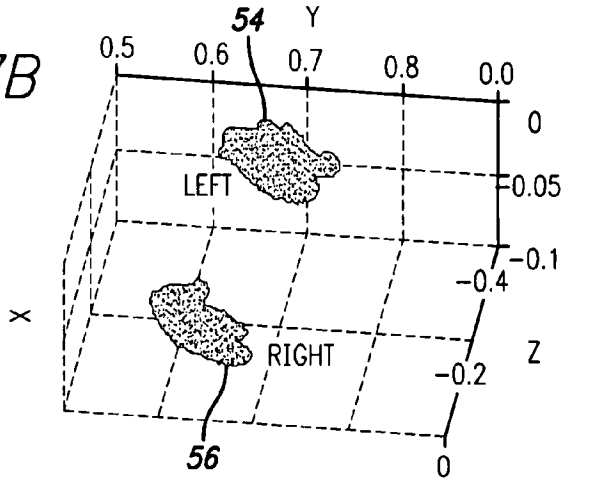
FIGS. 7A–D show the inferred positions of an actual human subject's hips throughout stepping as captured by a robotic device of the present invention.
Figure 7D:
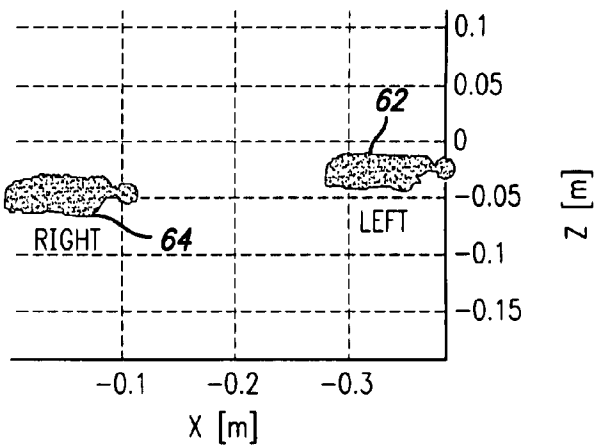
Figure 7A:
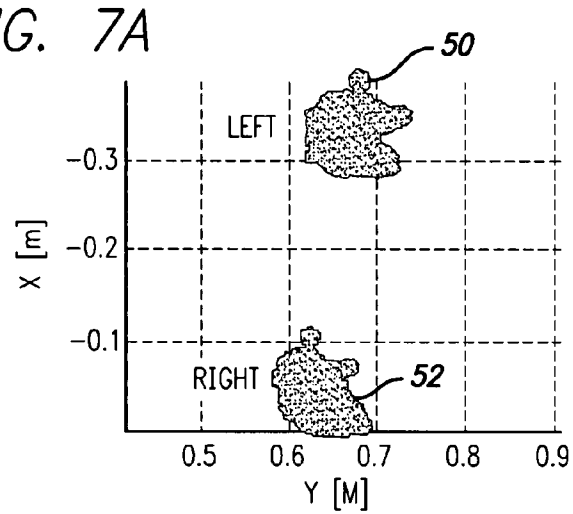
Figure 7C:
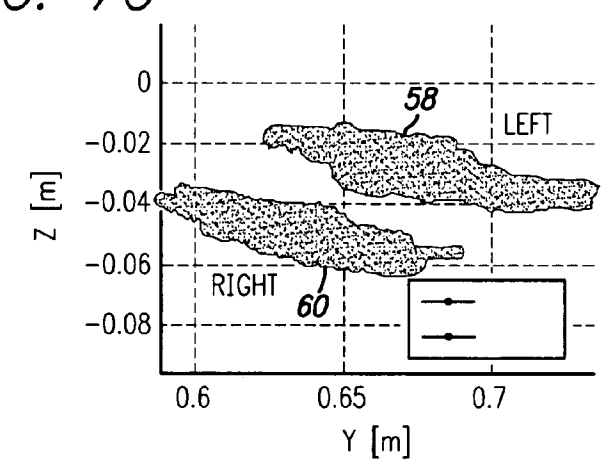

Position signals were collected from potentiometers on the pneumatic cylinders while an unimpaired subject made 100 steps over a treadmill moving at a constant speed of about 2 m/s. Forward kinematic equations were used to infer the position of the subject's hips throughout the stepping. FIGS. 7A–D show the inferred positions. FIG. 7A shows the position of the subject's left 50 and right 52 hip in the horizontal (X-Y) plane. FIG. 7B shows the subject's left 54 and right 56 hip in the X-Y-Z space. FIG. 7C shows the subject's left 58 and right 60 hip in the Y-Z plane. FIG. 7D shows the subject's left 62 and right 64 hip in the X-Z plane.

Figure 8B:
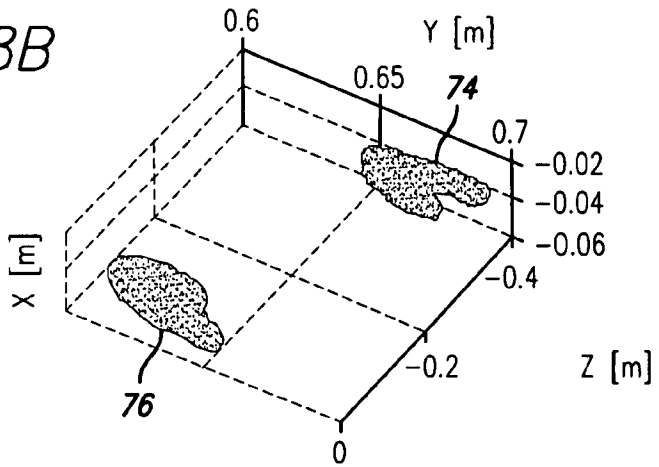
FIGS. 8A–D show the calculated average trajectory per step of the passive motion capture data of FIG. 6.
Figure 8D:
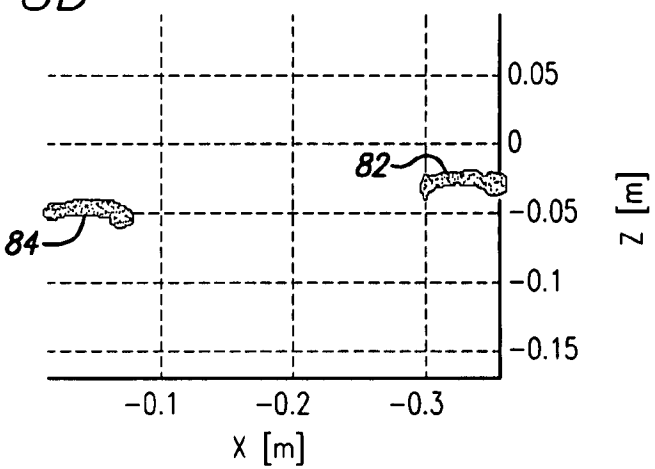
Figure 8A:
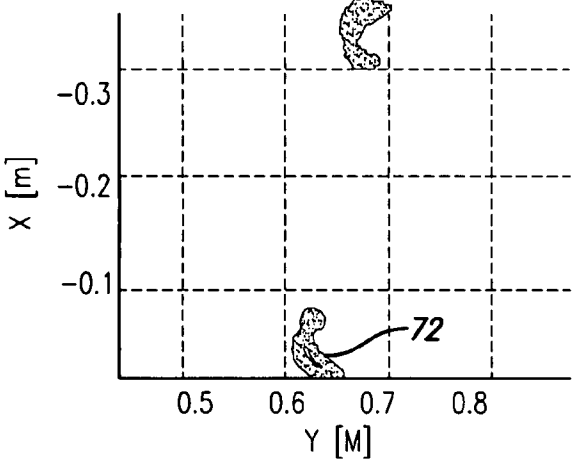
Figure 8C:
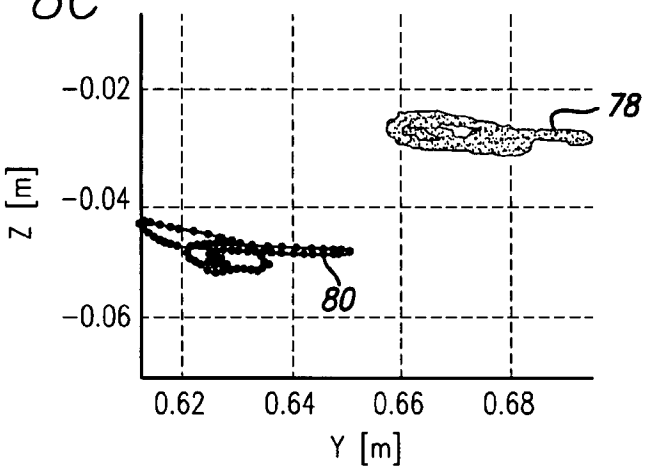

Calculated average hip trajectory per step of the passive motion capture data from FIGS. 7A–D are shown in FIGS. 8A–D. FIG. 8A shows the calculated trajectory for the left 70 and right 72 hip in the horizontal (X-Y) plane. FIG. 8B shows the calculated trajectory for the left hip 74 and right 76 hip in the X-Y-Z space. FIG. 8C shows the calculated trajectory for the left 78 and right 80 hip in the Y-Z plane. FIG. 8D shows the calculated trajectory for the left 82 and right 84 hip in the X-Z plane.

Inverse kinematics equations were used to transform the average trajectory back into input voltage signals for the pneumatic cylinders.

Example 2

This example shows the use of dynamic motion optimization applied to a fully actuated model. This model simulates normal human control of stepping.

Figure 9A:
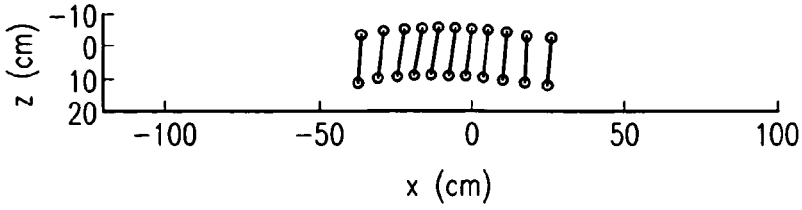
FIGS. 9A–C are graphic representations of one-half of the gait cycle found by motion capture of an actual human subject.
Figure 9B:
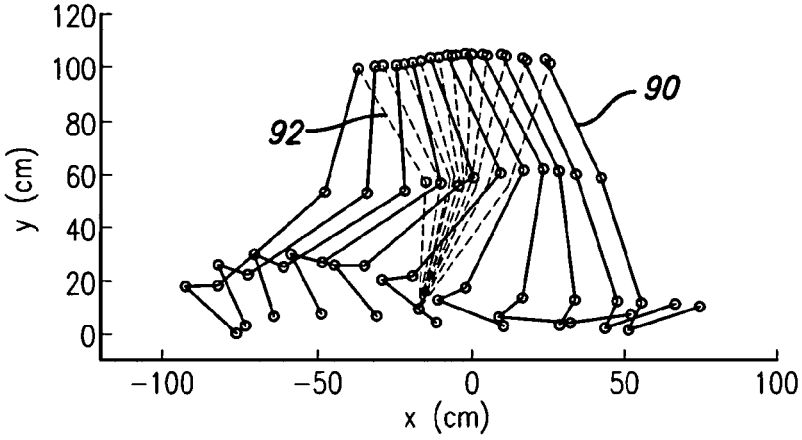
Figure 9C:
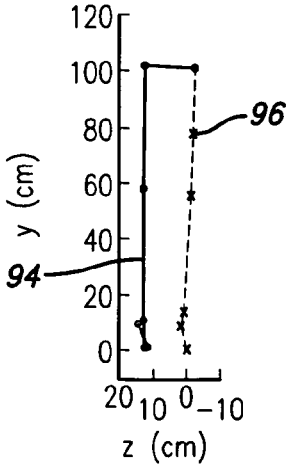

Motion capture data was obtained from an unimpaired human subject with a height of 1.95 m and a weight of 75 kg. The sampling rate of motion capture was 60 Hz. The treadmill speed was selected to be 1.25 m/sec to approximate a speed commonly used in step training with BWS training. FIGS. 9A–C show one representative step with a duration of 0.5 sec that was chosen for comparison with the optimization results. The positions of the external markers were converted to link lengths and joint angles based on forward kinematics. The X, Y and Z axes are oriented as shown in FIG. 5. FIG. 9A shows the subject's gait along the X-Z plane. FIG. 9B shows a side view of the gait along the X-Y plane, where a solid line 90 represents the subject's swing leg during the step cycle and a dashed line 92 represents the configuration of the stance leg. FIG. 9C shows a front view of the gait along the Y-Z plane, where the solid line 94 represents the swing leg and the dotted line 96 represents the stance leg.

The dynamic properties of the body segments were estimated using regression equations based on segment kinematic measurements such as shown by Zatsiorsky, V., and Seluyanov, V., "Estimation of the Mass and Inertia Characteristics of the Human Body by Means of the Best Predictive Regression Equations", Biomechanics IX-B 233–239, 1985.

A fully actuated human model with actuated hip and knee joints in the swing leg was examined. A total of 56 parameters (8 for each actuated joint) were used in the optimization. The penalty functions that limited the allowable out of plane motion of the legs were the minimum horizontal distances between the swing knee and the stance hip and between the swing heel and the stance hip, identified from motion capture.

Figure 10A:
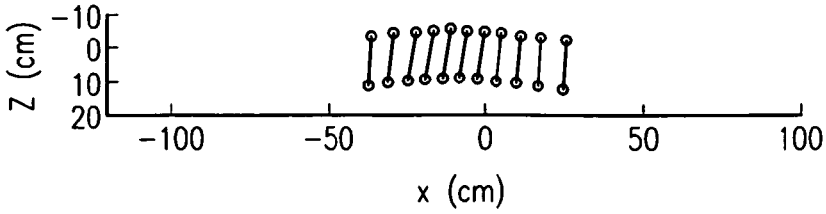
FIGS. 10A–C are graphic representations of the optimized motion computed for a fully actuated human model.
Figure 10B:
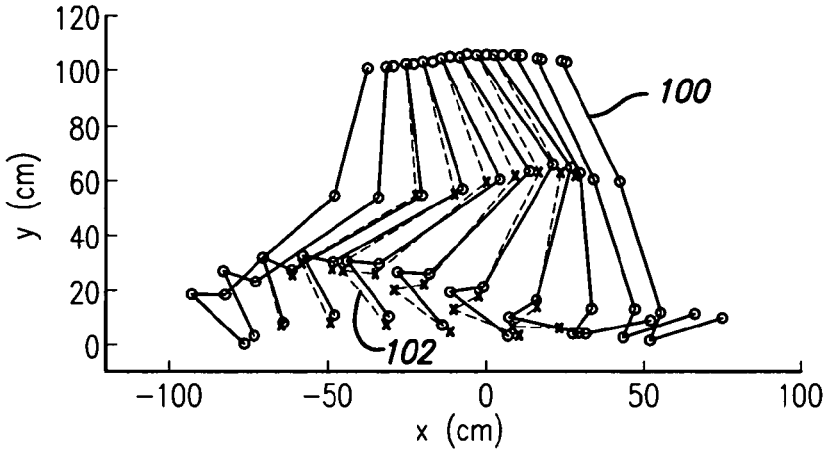
Figure 10C:
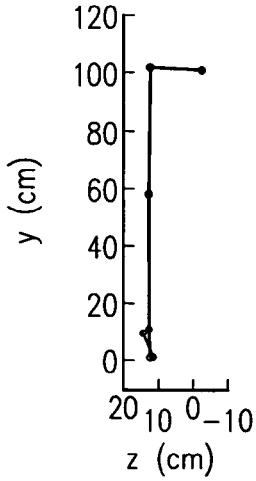

The weighting coefficients used for the optimization were chosen based on experience with many simulations. The optimization converged in 4 hours of computation with a Pentium II-700 Mhz PC. The resulting gaits, joint positions and joint torques are shown in FIGS. 10–12. FIG. 10A shows the gait in the X-Z plane. FIG. 10B shows the gait in the Y-X plane, with a solid line 100 representing the optimized gait and a dashed line 102 representing the actual human data for comparison. FIG. 10C shows the gait in the Y-Z plane.

Figure 11A:
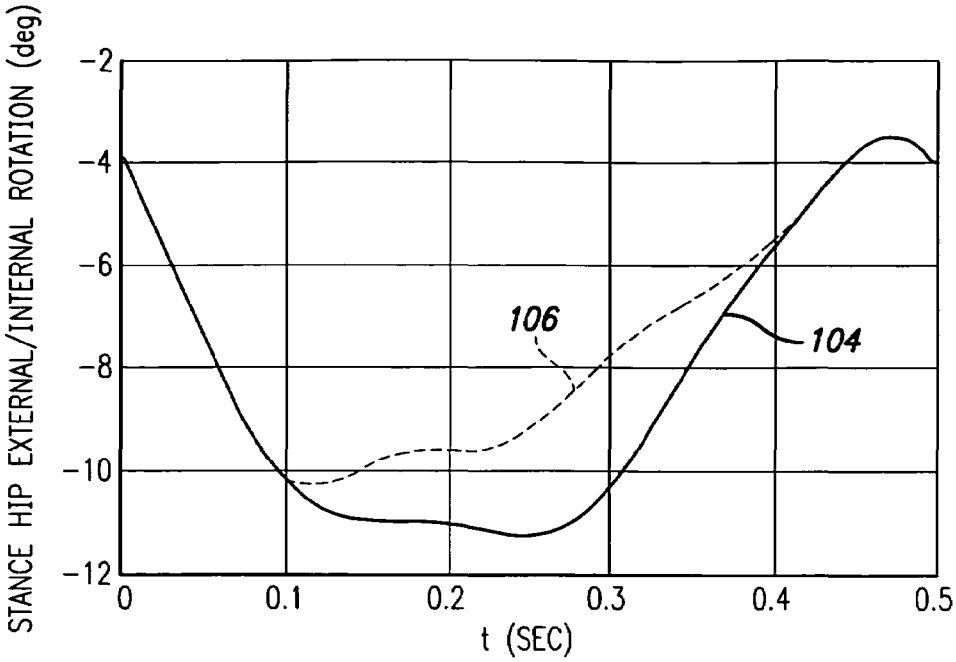
FIGS. 11A–G are graphs showing the joint motions for a fully actuated human model.
Figure 11B:
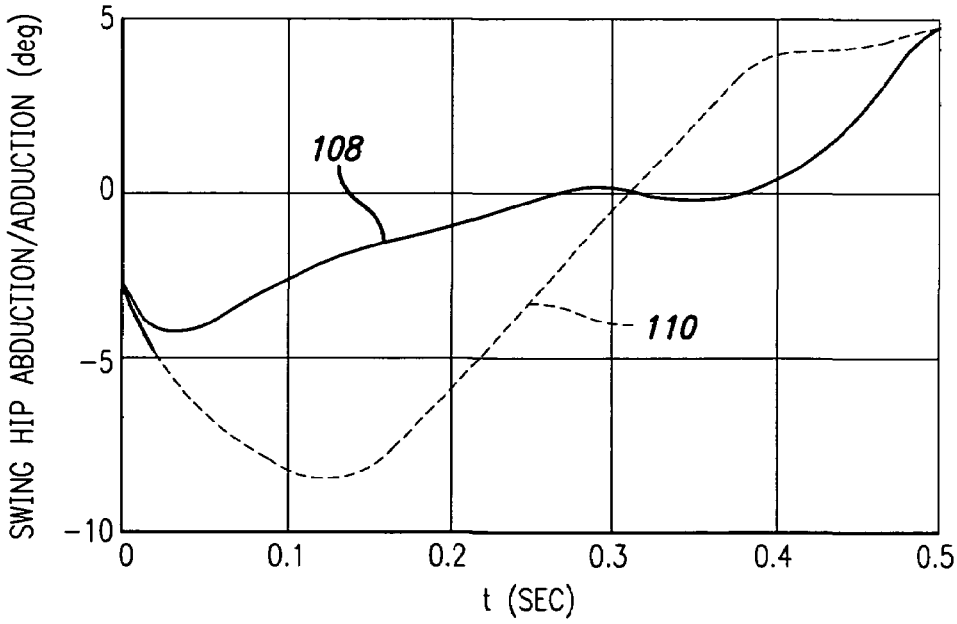
Figure 11C:
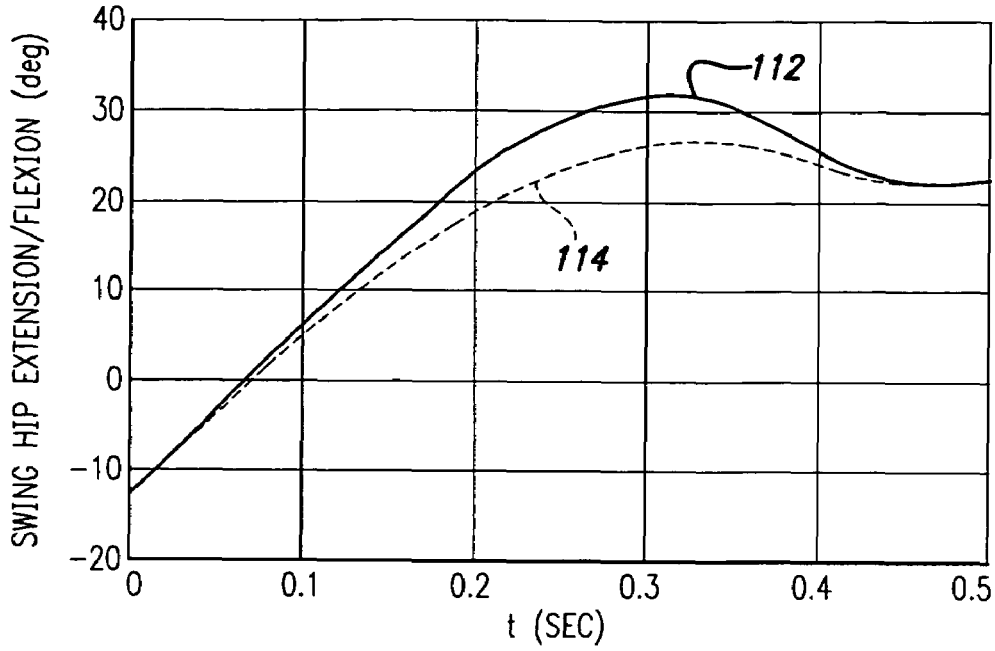
Figure 11D:
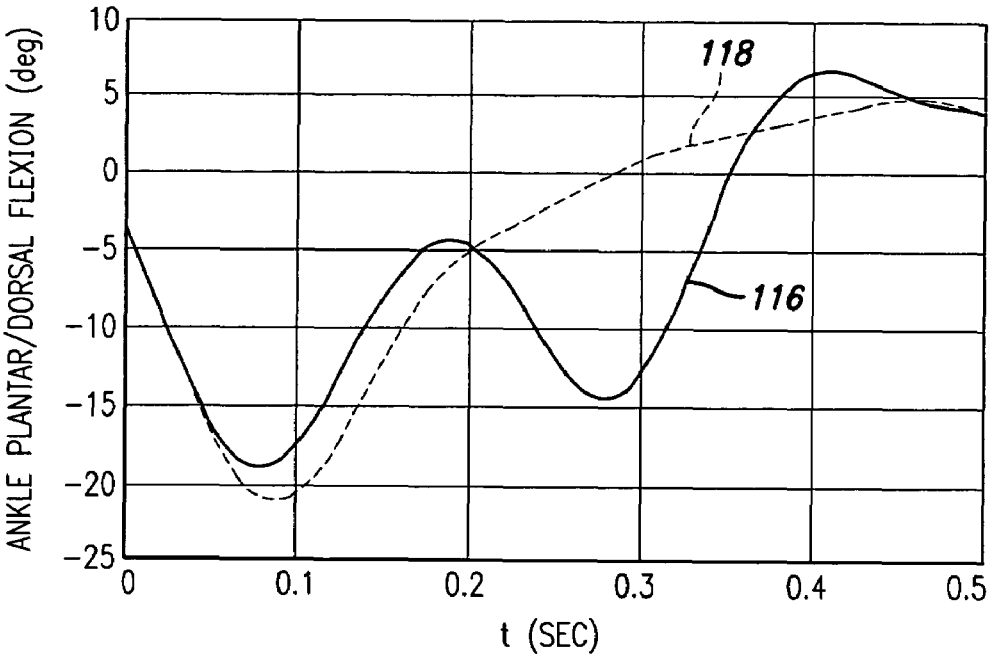
Figure 11E:
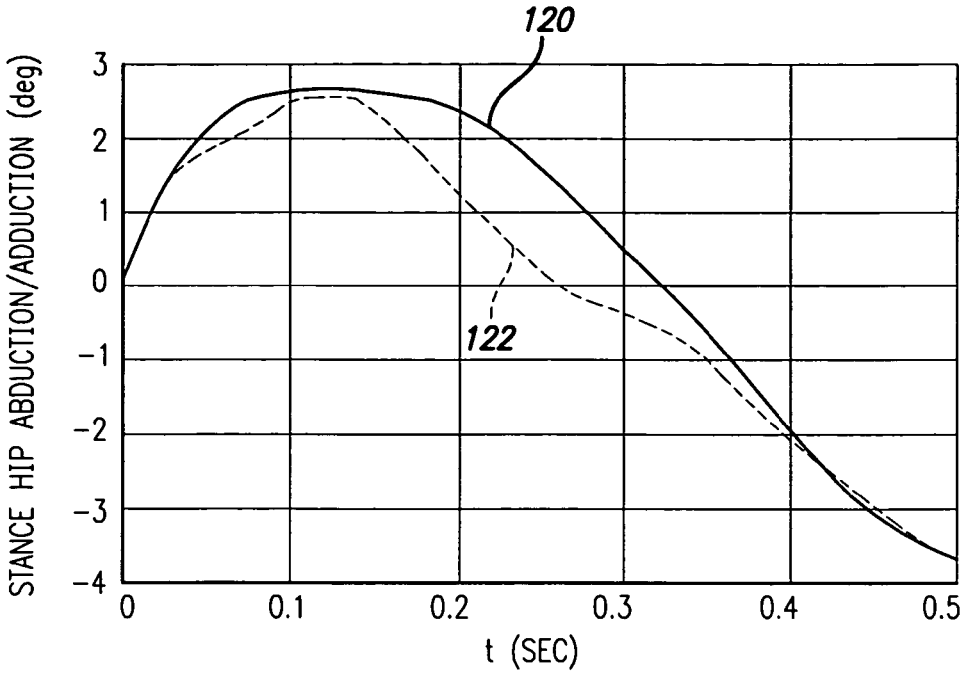
Figure 11F:
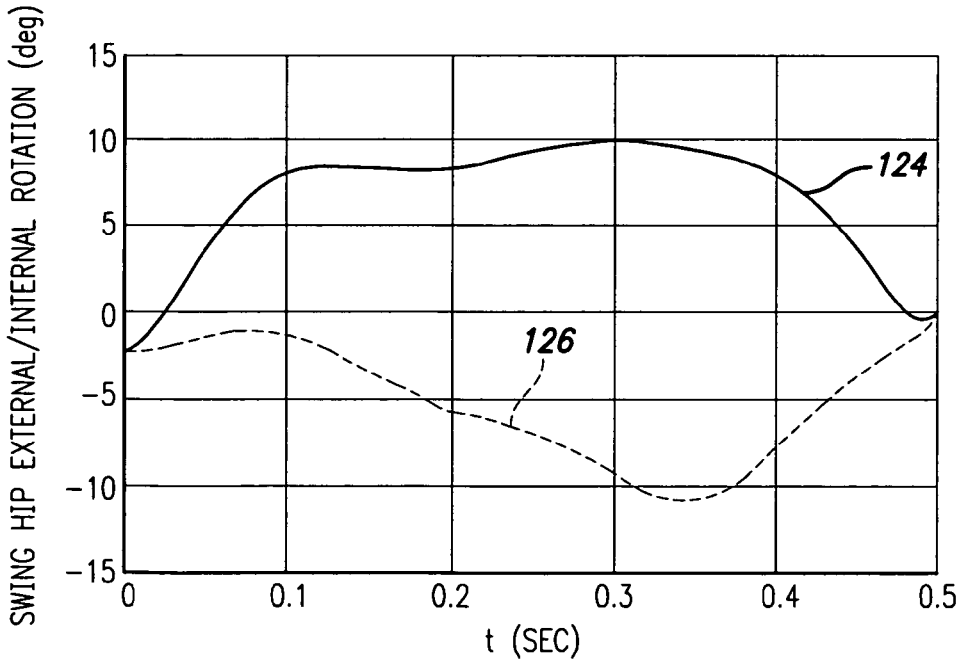
Figure 11G:
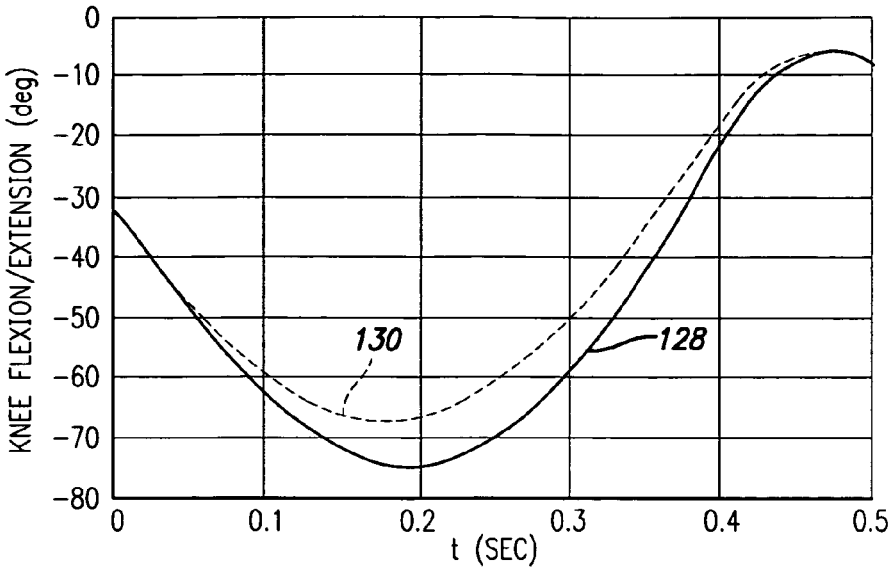

Referring to FIGS. 11A–G which show the joint angles in degrees during the step cycle, FIG. 11A shows the joint angles of the stance hip external/internal rotation for the optimized data 104 and the actual human data 106. FIG. 11B shows the joint angles of the swing hip abduction/reduction for the optimized data 108 and the actual human data 110. FIG. 11C shows the joint angles of the swing hip extention/flexion for the optimized data 112 and the actual human data 114. FIG. 11D shows the joint angles of the ankle plantar/dorsal flexion for the optimized data 116 and the actual human data 118. FIG. 11E shows the joint angles of the stance hip abduction/adduction for the optimized data 120 and the actual human data 122. FIG. 11F shows the joint angles of the swing hip external/internal rotation for the optimized data 124 and the actual human data 126. FIG. 11G shows the joint angles of the knee flexion/extension for the optimized data 128 and the actual human data 130.

Figure 12A:
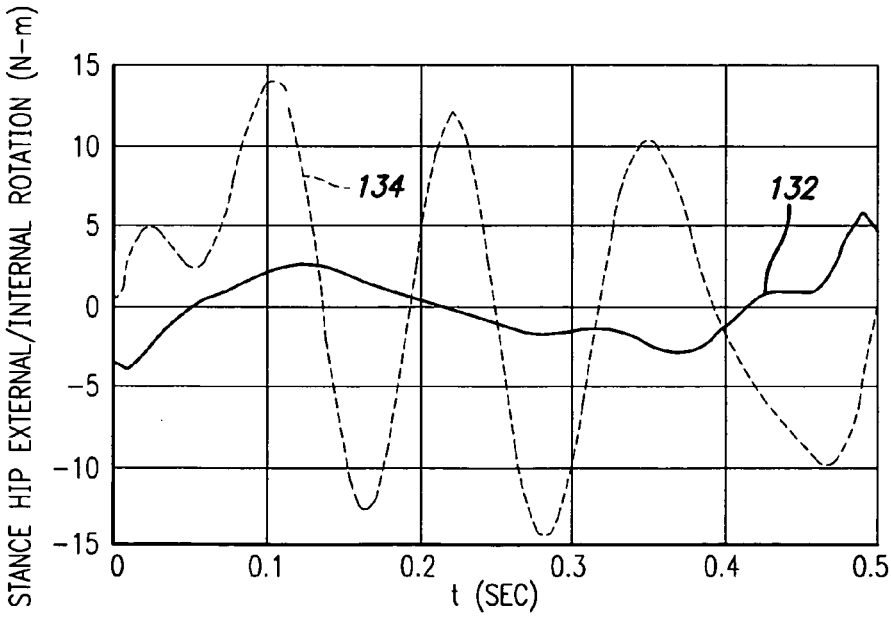
FIGS. 12A–G are graphs showing the joint torques for a fully actuated human model.
Figure 12B:
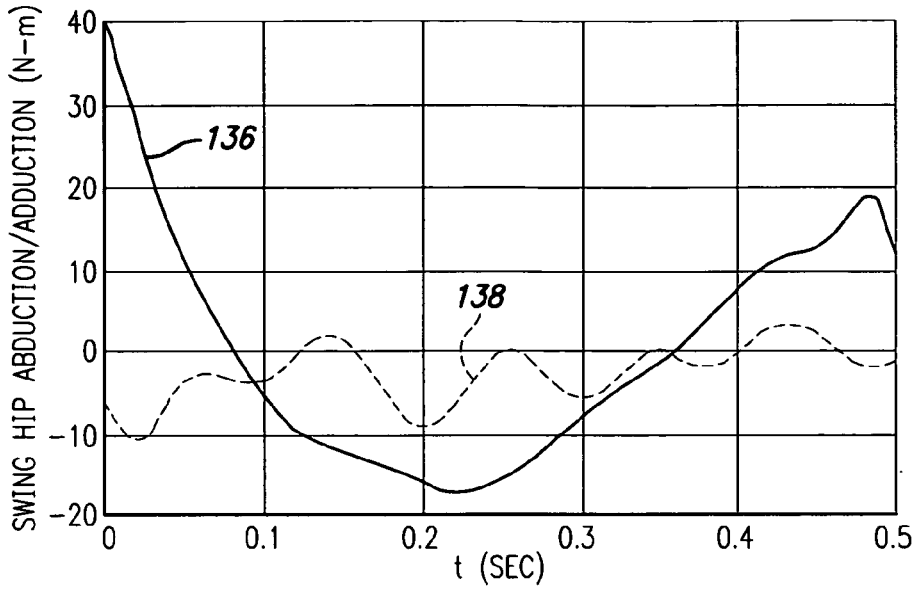
Figure 12C:
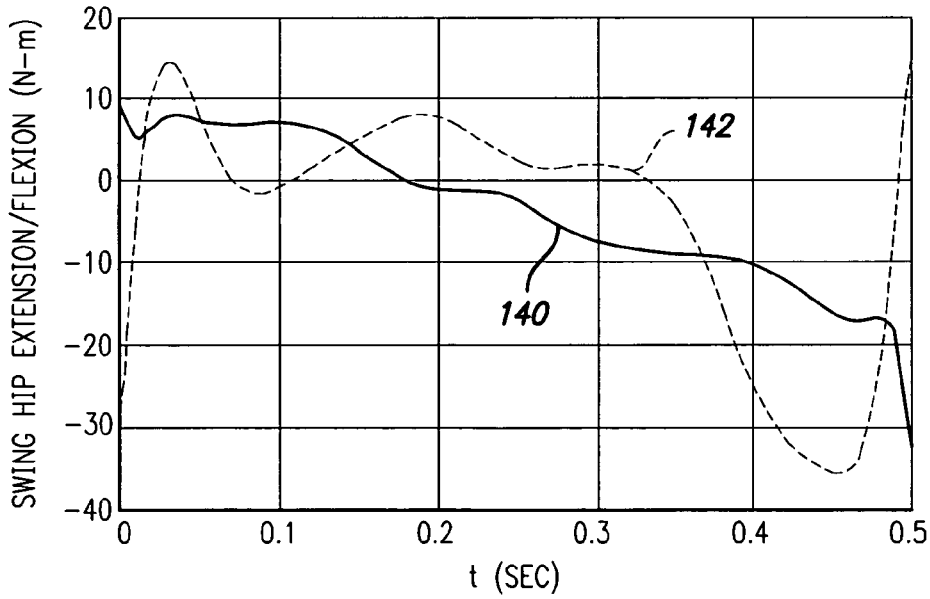
Figure 12D:
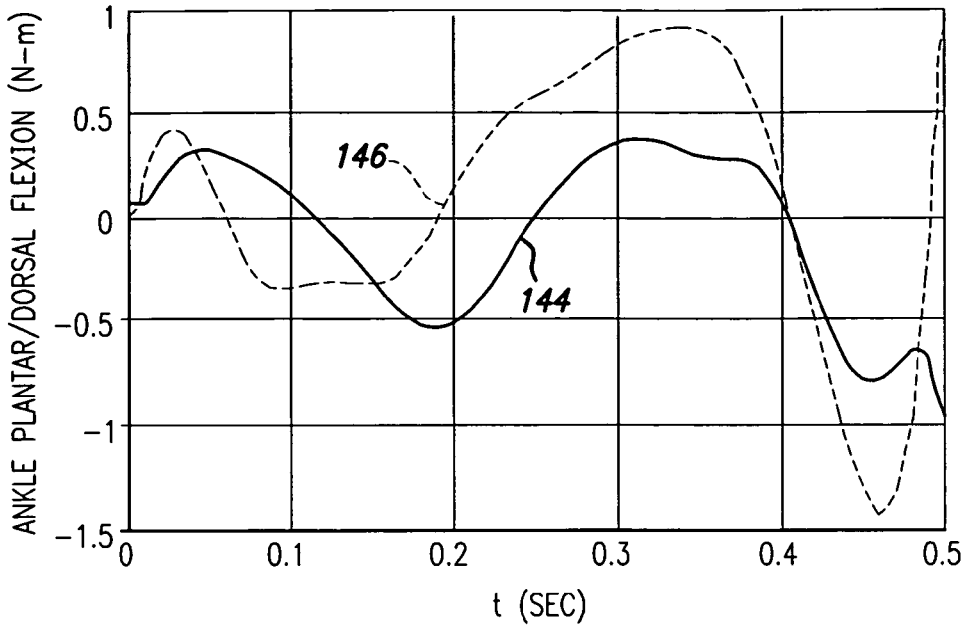
Figure 12E:
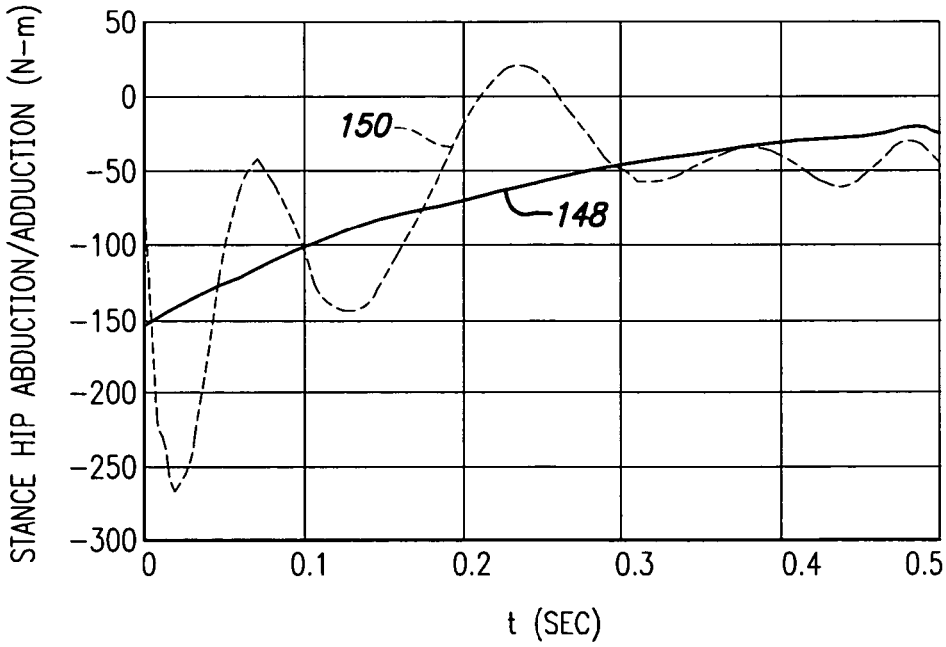
Figure 12F:
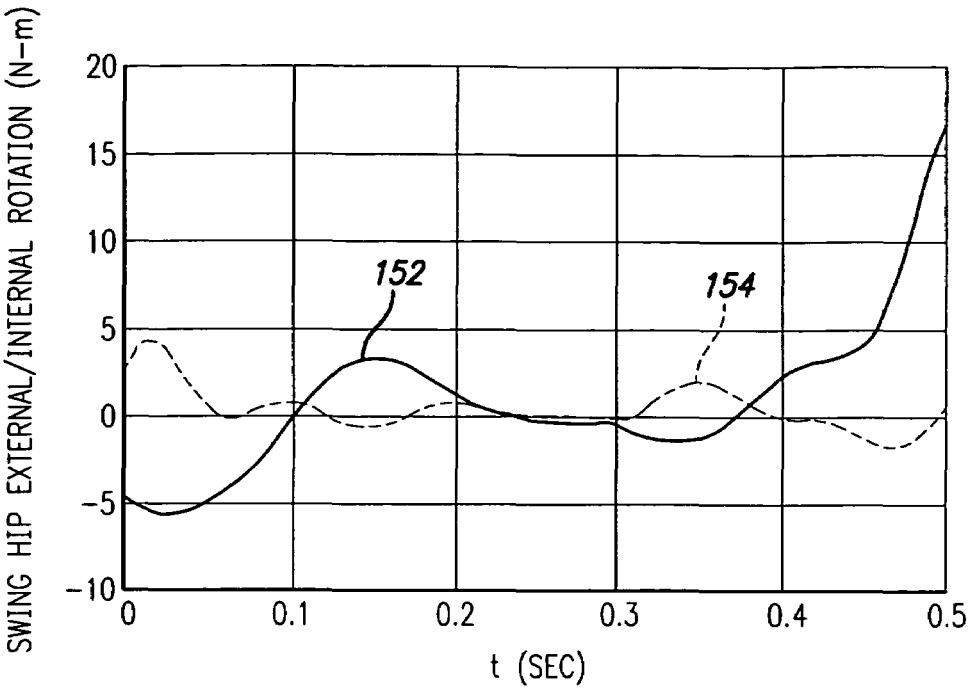
Figure 12G:
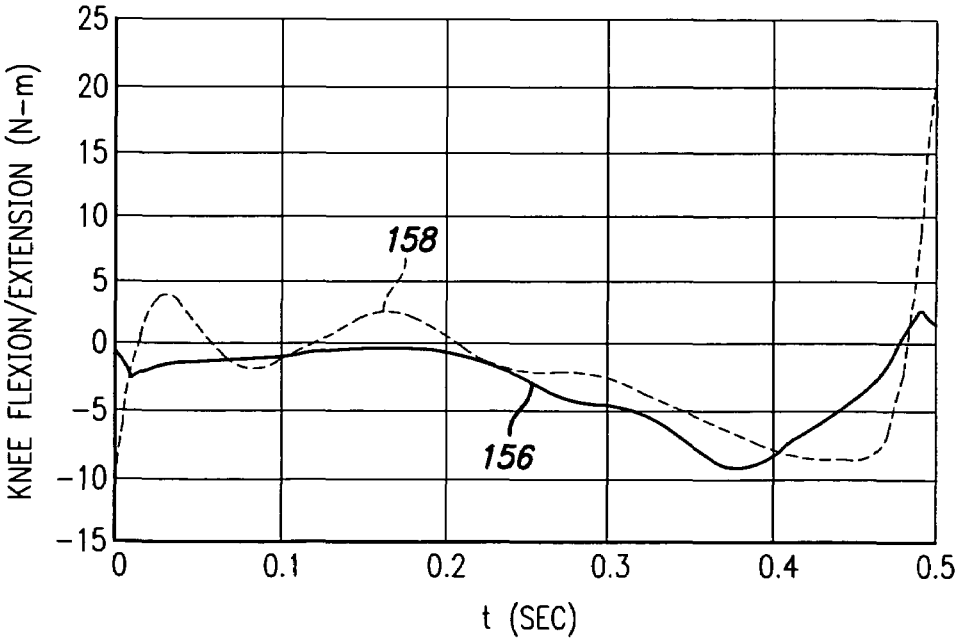

Referring to FIGS. 12A–G which show the joint torques in N-m during the step cycle, FIG. 12A shows the joint torques of the stance hip external/internal rotation for the optimized data 132 and the actual human data 134. FIG. 12B shows the joint torques of the swing hip abduction/reduction for the optimized data 136 and the actual human data 138. FIG. 12C shows the joint torques of the swing hip extention/flexion for the optimized data 140 and the actual human data 142. FIG. 12D shows the joint torques of the ankle plantar/dorsal flexion for the optimized data 144 and the actual human data 146. FIG. 12E shows the joint torques of the stance hip abduction/adduction for the optimized data 148 and the actual human data 150. FIG. 12F shows the joint torques of the swing hip external/internal rotation for the optimized data 152 and the actual human data 154. FIG. 12G shows the joint torques of the knee flexion/extension for the optimized data 156 and the actual human data 158.

The good correspondence with the human data suggests that human gait involves the minimization of effort. This effort/energy is applied to lift the swing leg to avoid contact with the ground and to achieve the final configuration. Moreover, the correspondence between the optimized and actual pelvic and leg joint motions (FIGS. 10A–C) suggests that the optimization technique can adequately predict what a normative trajectory would be, given only the limb dynamics and desired final configuration of the leg.

Example 3

This example shows the use of dynamic motion optimization applied to an under-actuated model, which simulates a paralyzed subject.

For this analysis, the swing hip, knee and ankle joints were made passive. A total of 16 parameters (8 for each actuated joint) were used in the optimization. The optimization took approximately 3.5 hours to complete. The results are shown in FIGS. 13–15.

Figure 13A:
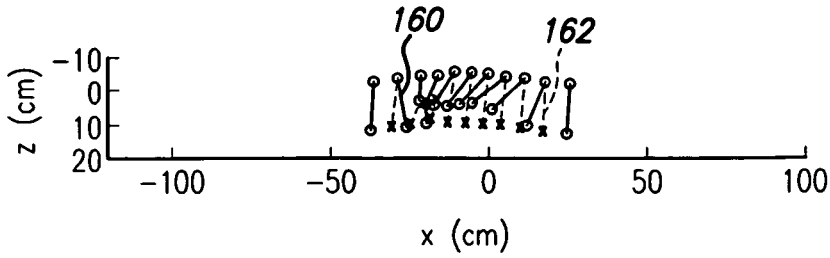
FIGS. 13A–C are graphic representations of the optimized motion computed for an under-actuated human model.
Figure 13B:
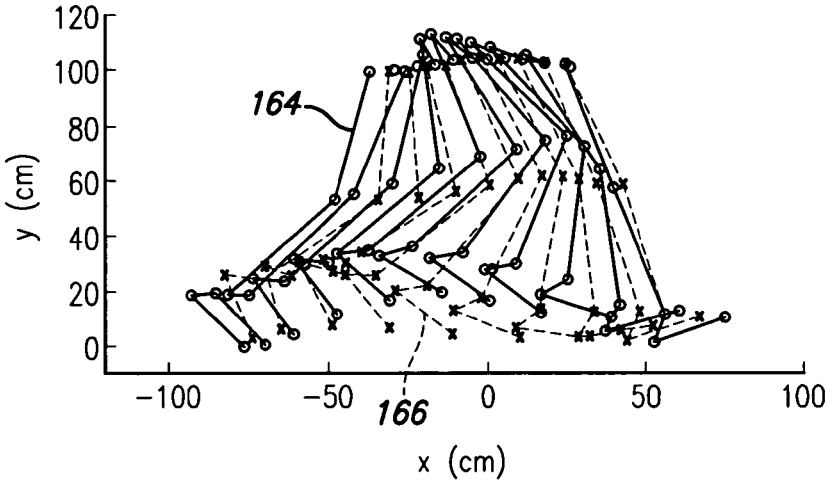
Figure 13C:
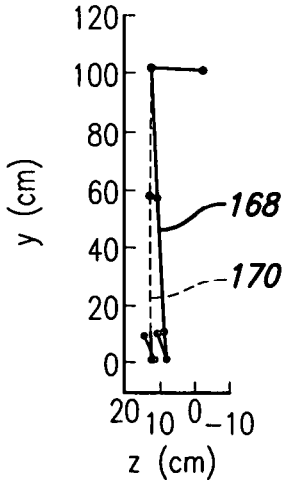

Referring to FIGS. 13A–C, FIG. 13A shows the gait in the X-Z plane, with a solid line 160 representing the optimized gait and a dashed line 162 representing the actual human data. FIG. 13B shows the gait in the Y-X plane, with a solid line 164 representing the optimized gait and a dashed line 166 representing the actual human data. FIG. 13C shows the gait in the Y-Z plane with the solid line 168 representing the optimized gait and the dashed line 170 representing the actual human data.

Figure 14A:
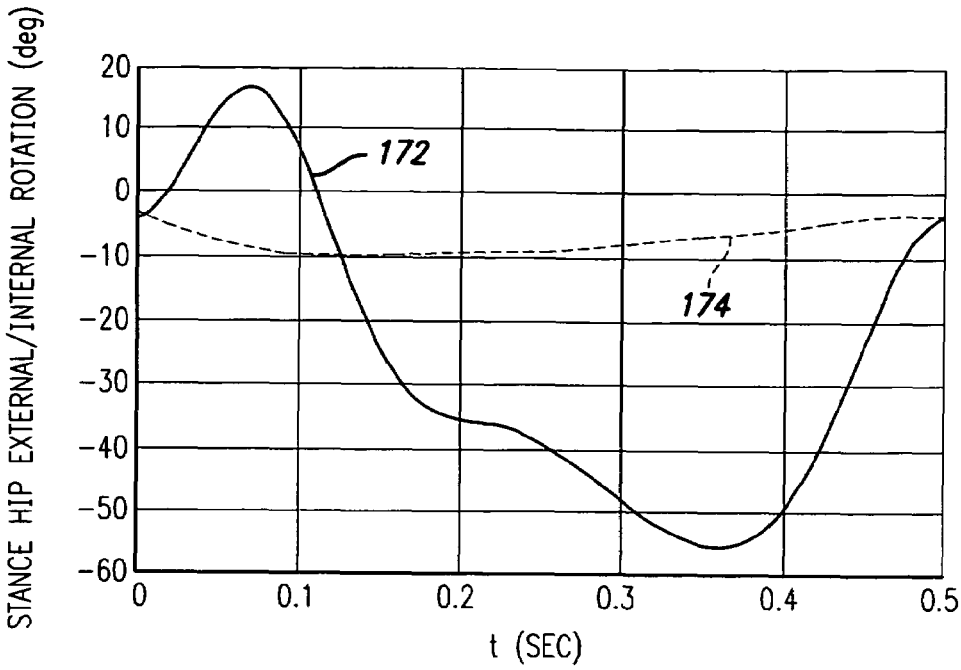
FIGS. 14A–G are graphs showing the joint motions for an under-actuated human model.
Figure 14B:
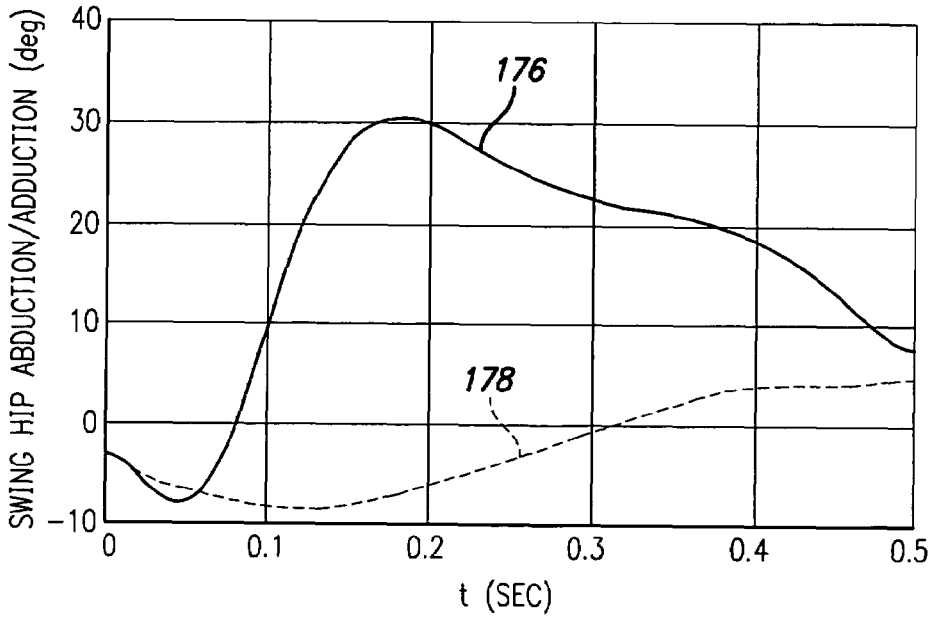
Figure 14C:
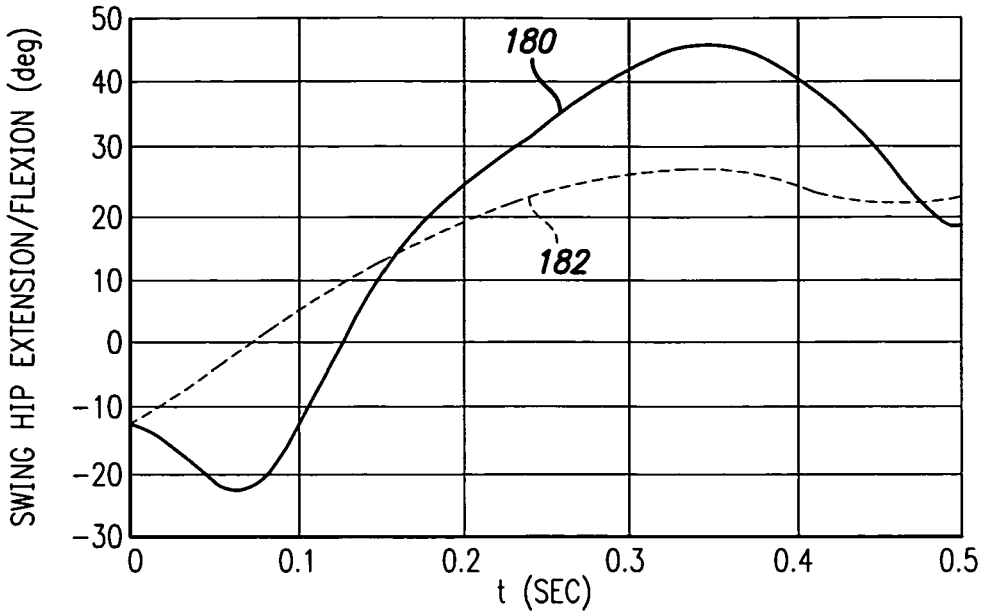
Figure 14D:
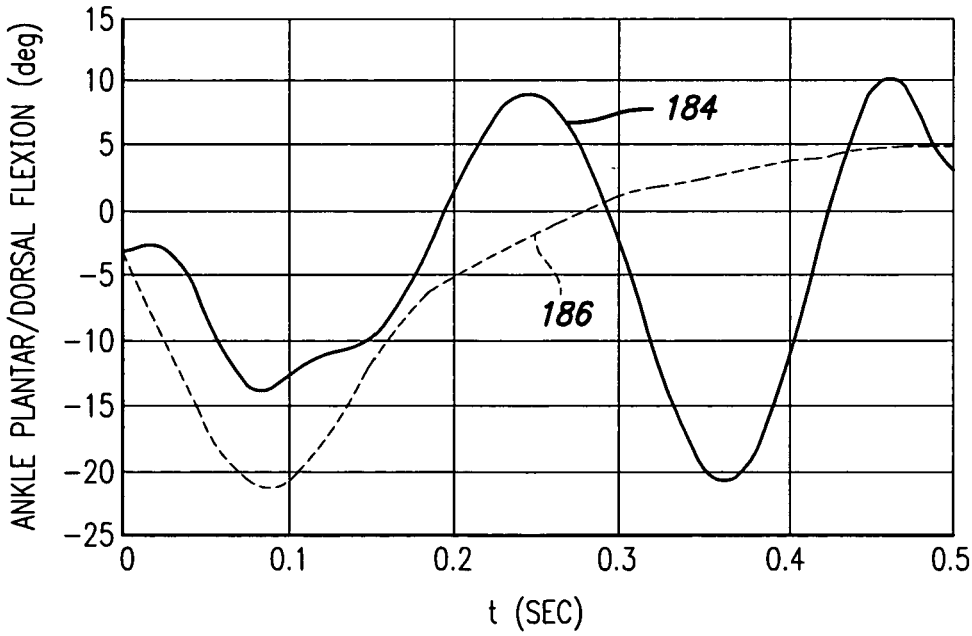
Figure 14E:
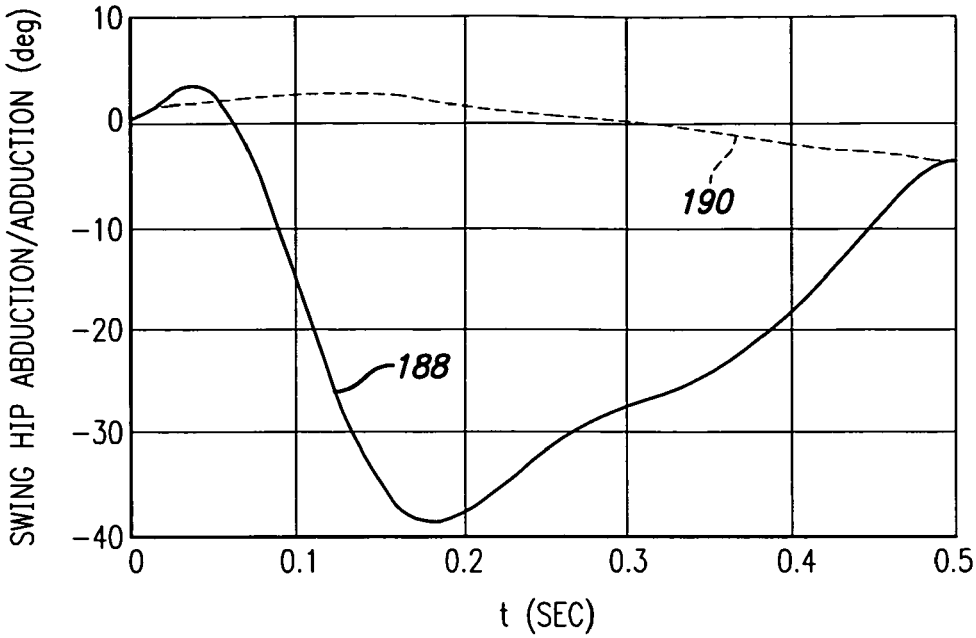
Figure 14F:
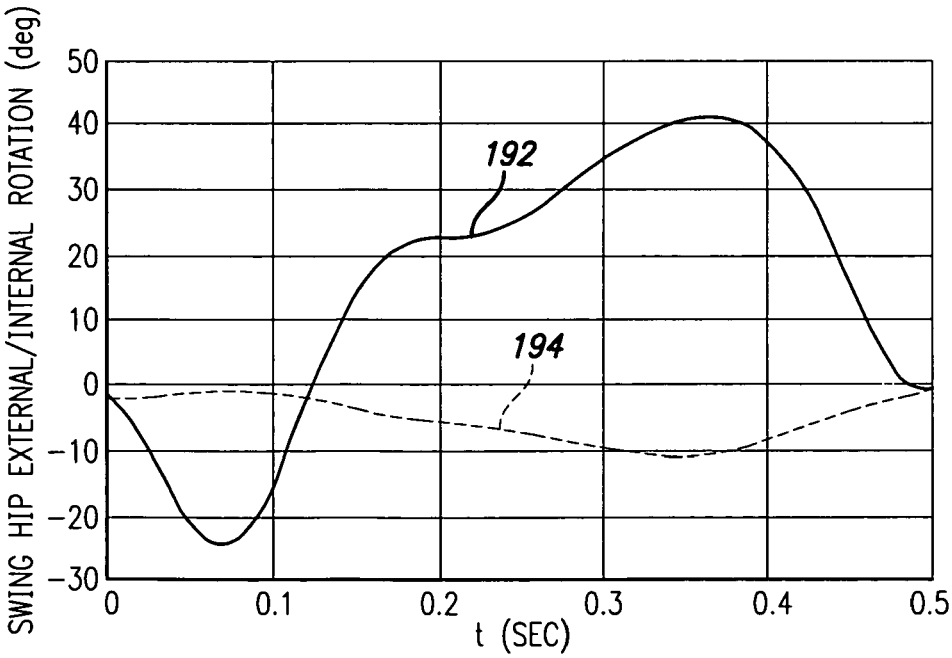
Figure 14G:
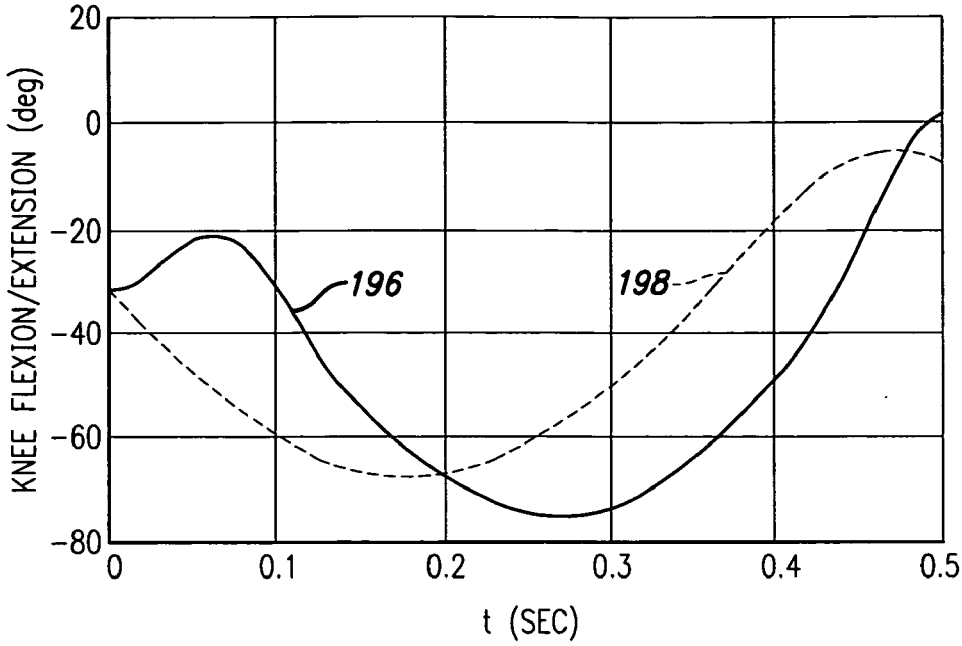

Referring to FIGS. 14A–G which show the joint angles in degrees during the step cycle, FIG. 14A shows the joint angles of the stance hip external/internal rotation for the optimized data 172 and the actual human data 174. FIG. 14B shows the joint angles of the swing hip abduction/reduction for the optimized data 176 and the actual human data 178. FIG. 14C shows the joint angles of the swing hip extention/flexion for the optimized data 180 and the actual human data 182. FIG. 14D shows the joint angles of the ankle plantar/dorsal flexion for the optimized data 184 and the actual human data 186. FIG. 14E shows the joint angles of the stance hip abduction/adduction for the optimized data 188 and the actual human data 190. FIG. 14F shows the joint angles of the swing hip external/internal rotation for the optimized data 192 and the actual human data 194. FIG. 14G shows the joint angles of the knee flexion/extension for the optimized data 196 and the actual human data 198.

Figure 15A:
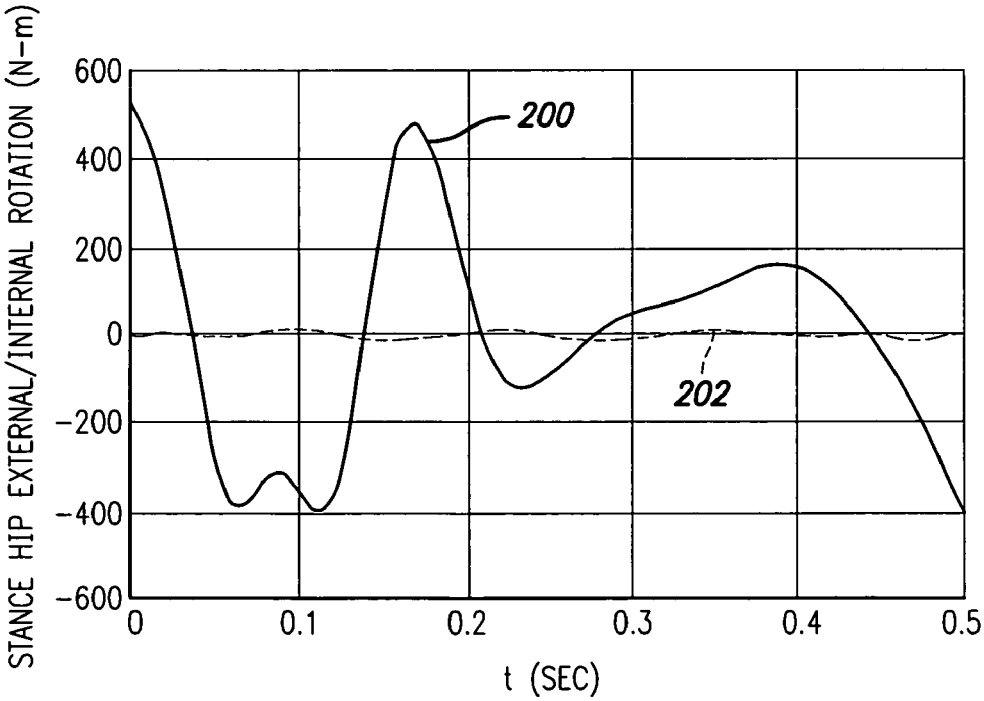
FIGS. 15A and 15B are graphs showing the stance hip torques for an under-actuated human model.
Figure 15B:
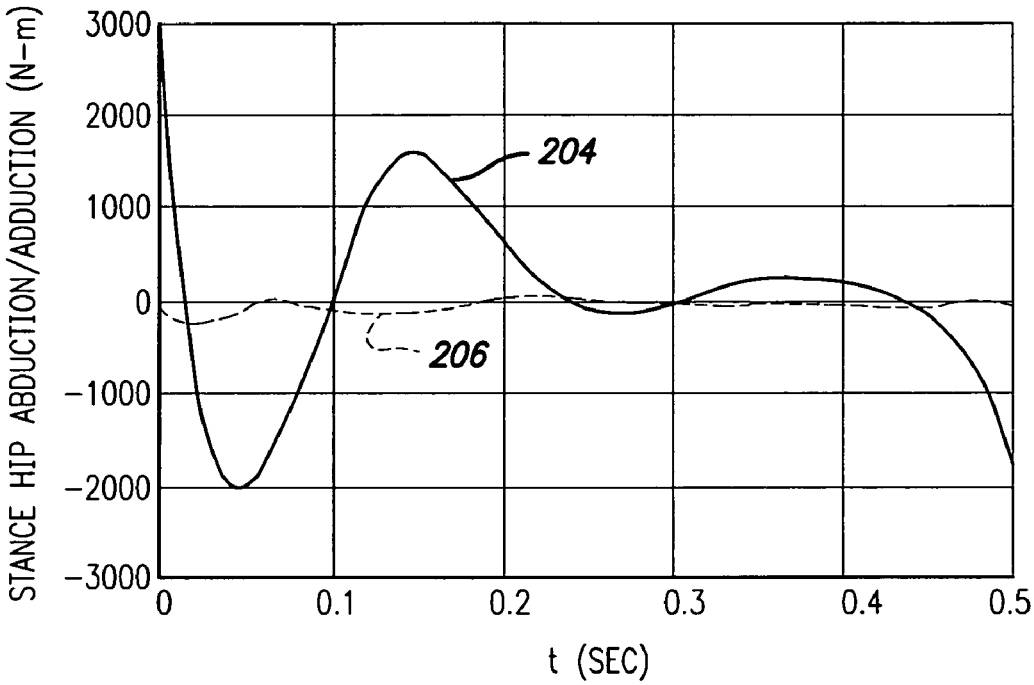

Referring to FIGS. 15A and B which show the joint torques in N-m during the step cycle, FIG. 15A shows the joint torques of the stance hip external/internal rotation for the optimized data 200 and the actual human data 202. FIG. 15B shows the joint torques of the stance hip abduction/adduction for the optimized data 204 and the actual human data 206.

The optimizer lifted the swing hip to avoid collision between the swing leg and the ground. At the same time, it twisted the pelvis to pump energy into the paralyzed leg and moved the leg close to the desired final configuration, while avoiding collision between the legs. Thus the optimizer was able to determine a strategy that could achieve repetitive stepping by shifting the pelvis alone. The strategy incorporated a large swivel of the stance hip joint around the y-axis which may be undesirable in step training a real human. Similar optimizations that constrained the stance hip rotation and achieved the desired step pattern were also performed.

The results demonstrate the feasibility of incorporating robotic control of pelvic motion into BWS training. Although full control of swing by manipulating the pelvis may be difficult to achieve, the level of control that is possible appears sufficient for achieving reasonable swing trajectories and an approximate normal leg configuration at heel strike. This level of control can enable repetitive stepping on a treadmill by a completely paralyzed person. Further, the pelvic motions generated to control swing do not necessarily require large, non-physiological joint movements. A hip swinging robot can also be useful for loading the stance leg by pressing downward on the stance hip, thus providing load-related sensory input required for stepping at the same time as assisting in swing.

Although the present invention and its advantages have been described in detail, it should be understood that various changes, substitutions and alterations can be made herein without departing from the spirit and scope of the invention. Moreover, the scope of the present application is not intended to be limited to the particular embodiments of the process, machine, means, methods and/or steps described in the specification. As one of ordinary skill in the art will readily appreciate from the disclosure of the present invention, processes, machines, means, methods, or steps, presently existing or later to be developed that perform substantially the same function or achieve substantially the same result as the corresponding embodiments described herein may be utilized according to the present invention. Accordingly, the invention is intended to include within its scope such processes, machines, means, methods, or steps.

REFERENCES

The following publications are hereby incorporated by reference:

1. Albro et al., On the computation of optimal high-dives. IEEE International Conference on Robotics and Automation 4:3958–3963, 2000.
2. Barbeau, et al., Does neurorehabilitation play a role in the recovery of walking in neurological populations? Annals New York Academy of Sciences 860: 377–392, 1998.
3. Bejczy, A., Towards development of robotic aid for rehabilitation of locomotion-impaired subjects. Proc. 1st Workshop Robot Motion and Control (RoMoCo'99), pp. 9–16, 1999.
4. Bobrow, J. E. and B. W. McDonell, Modeling, identification, and control of a pneumatically actuated, force controllable robot. IEEE Transactions on Robotics and Automation, vol. 14, pp. 732–42, 1998.
5. Colombo, G., et al., Treadmill training of paraplegic patients with a robotic orthosis. Journal of Rehabilitation Research and Development, vol. 37, pp. 693–700, 2000.
6. Edgerton, V. R., et al., Retraining the injured spinal cord. J Physiology (London), vol. 533, pp. 15–22, 2001.
7. Hesse, S. and D. Uhlenbrock, Gait pattern of severely disabled hemiparetic subjects on a new controlled gait trainer as compared to assisted treadmill walking with partial body weight support. Clinical Rehabilitation 13:401–10, 1999.
8. Hesse, S. and D. Uhlenbrock, A mechanized gait trainer for restoration of gait. Journal of Rehabilitation Research and Development, vol. 37, pp. 701–8, 2000.
9. Hodgins, J. K., Three-dimensional human running. IEEE International Conference on Robotics and Automation 4:3271–3276, 1996.

10. Krebs, H. I., et al., Increasing productivity and quality of care: Robot-aided neuro-rehabilitation. Journal of Rehabilitation Research and Development, vol. 37, pp. 639–52, 2000.
11. Pandy, M. G. and F. C. Anderson, Dynamic simulation of human movement using large-scale models of the body. IEEE International Conference on Robotics and Automation 1:676–681, 2000.
12. Reinkensmeyer, D., et al., A robotic stepper for retraining locomotion in spinal-injured rodents. San Francisco, Calif., April. Proc 2000 IEEE International Conference on Robotics and Automation, pp. 2889–2894, 1999.
13. Reinkensmeyer, D., et al., A robotic tool for studying locomotor adaptation and rehabilitation. Second Joint Meeting of the IEEE Engineering in Medicine and Biology Society and the Biomedical Engineering Society, pp. 2353–2354, 2002.
14. Sohl, G. A., and Bobrow, J. E., A recursive multibody dynamics and sensitivity algorithm for branched kinematic chains. ASME Journal of Dynamic Systems, Measurement and Control, 391–399, 2001.
15. Townsend, W. T. and J. A. Guertin, Teleoperator slave-WAM design methodology. Industrial Robot, vol. 26, pp. 167–177, 1999.
16. Wang, C-Y. E., Optimal Path Generation For Robots. Ph.D. Thesis, University of California, Irvine, 2001.
17. Wang, et al., Weightlifting motion planning for a Puma 762 robot. IEEE International Conference on Robotics and Automation 1:480–485, 1999.
18. Wang, C. E., et al., Swinging from the hip: Use of dynamic motion optimization in the design of robotic gait rehabilitation. Proceedings 2001 IEEE International Conference on Robotics & Automation, pp. 1433–8, 2001.
19. Wickelgren, I., Teaching the spinal cord to walk. Science 279:319–321, 1998.
20. Zatsiorsky, V., and Seluyanov, V., Estimation of the mass and inertia characteristics of the human body by means of the best predictive regression equations, Biomechanics IX-B 233–239, 1985.

The invention claimed is:

1. A robotic device for manipulating and/or measuring the pelvic motion of a subject undergoing locomotion training, the device comprising at least one backdriveable robot for attaching to the torso of the subject and for applying force to the pelvis of the subject to thereby cause the subject's legs to move along a surface.

2. The device of claim 1 comprising a pair of backdriveable robots, each robot for attaching to the torso of the subject and for applying force to the pelvis of the subject.

3. The device of claim 1 wherein the robot comprises a plurality of pneumatic actuators.

4. The device of claim 3 wherein the robot comprises three pneumatic actuators.

5. The device of claim 4 wherein each pneumatic actuator is a pneumatic cylinder.

6. The device of claim 5 wherein the three pneumatic cylinders connect to each other at their rod ends for attachment to the subject's torso.

7. A robotic device for manipulating and/or measuring the pelvic motion of a subject undergoing locomotion training, the device comprising a pair of backdriveable robots for attaching to the torso of the subject and for applying force to the pelvis of the subject, each robot comprising three pneumatic cylinders which connect to each other at their rod ends for attachment to the subject's torso.

8. A system for locomotion therapy, comprising:

(a) a surface;

(b) a support system for supporting a subject over the surface to position at least one of the subject's legs thereupon; and (c) a robotic device comprising at least one backdriveable robot for attaching to the torso of the supported subject and for applying force to the pelvis of the supported subject to thereby cause the legs to move along the surface.

9. The system of claim 8 wherein the surface is a moveable surface.

10. The system of claim 8 wherein the robotic device comprises a pair of backdriveable robots, each robot for attaching to the torso of the subject and for applying force to the pelvis of the subject.

11. The system of claim 8 wherein the robot comprises a plurality of pneumatic actuators.

12. The system of claim 11 wherein the robot comprises three pneumatic actuators.

13. The system of claim 12 wherein each pneumatic activator is a pneumatic cylinder.

14. The system of claim 13 wherein the three pneumatic cylinders connect to each other at their rod ends for attachment to the subject's torso.

15. A system for locomotion therapy, comprising:

(a) a moveable surface;

(b) a suspension system for suspending a subject over the moveable surface to position at least one of the subject's legs thereupon; and (c) a robotic device comprising a pair of backdriveable robots for attaching to the torso of the suspended subject and for applying force to the pelvis of the suspended subject, each robot comprising three pneumatic cylinders which connect to each other at their rod ends for attachment to the subject's torso.

16. A system for locomotion therapy, comprising:

(a) a surface; and (b) a robotic device comprising at least one backdriveable robot for attaching to the torso of a subject, for applying force to the pelvis of the subject to thereby cause the subject's legs to move along the surface, and for supporting the subject over the surface.

17. The system of claim 16 wherein the surface is a moveable surface.

18. The system of claim 16 wherein the robotic device comprises a pair of backdriveable robots, each robot for attaching to the torso of the subject and for applying force to the pelvis of the subject.

19. The system of claim 16 wherein the robot comprises a plurality of pneumatic actuators.

20. The system of claim 19 wherein the robot comprises three pneumatic actuators.

21. The system of claim 20 wherein each pneumatic activator is a pneumatic cylinder.

22. The system of claim 21 wherein the three pneumatic cylinders connect to each other at their rod ends for attachment to the subject's torso.

23. A system for locomotion therapy, comprising:

(a) a moveable surface; and (b) a robotic device comprising a pair of backdriveable robots for attaching to the torso of a subject, for applying force to the pelvis of the subject, and for supporting the subject over the surface, each robot comprising three pneumatic cylinders which connect to each other at their rod ends for attachment to the subject's torso.

24. A backdriveable robot for manipulating and/or measuring the limb movement of a subject undergoing physical training of a limb, the robot comprising three pneumatic cylinders that connect to each other at their rod ends for attachment to the subject's limb.

25. The device of claim 24 wherein the limb is a leg of the subject.

26. A method of locomotion training of a subject, comprising:

(a) providing a movable surface;

(b) suspending the subject over the movable surface to position at least one of the subject's legs thereupon;

(c) providing a robotic device comprising two backdriveable pneumatic robots;

(d) attaching the robotic device to the torso of the suspended subject; and (e) shifting the suspended subject's pelvis by activating the robotic device, thereby causing the subject's legs to move along the movable surface.

* * * * *